US009027298B1

(12) United States Patent
Martinez

(10) Patent No.: US 9,027,298 B1
(45) Date of Patent: May 12, 2015

(54) MODULAR SYSTEM AND METHOD FOR CONSTRUCTING STRUCTURES

(71) Applicant: Marcos E Martinez, Miami, FL (US)

(72) Inventor: Marcos E Martinez, Miami, FL (US)

( * ) Notice: Subject to any disclaimer, the term of this patent is extended or adjusted under 35 U.S.C. 154(b) by 0 days.

(21) Appl. No.: 14/546,193

(22) Filed: Nov. 18, 2014

(51) Int. Cl.

| | |
|---|---|
| ***E04B 5/00*** | (2006.01) |
| ***E04B 7/00*** | (2006.01) |
| ***E04C 2/38*** | (2006.01) |
| ***E04B 2/00*** | (2006.01) |
| ***E04B 5/02*** | (2006.01) |
| ***E04B 7/20*** | (2006.01) |
| ***E04B 9/04*** | (2006.01) |
| ***E04H 1/00*** | (2006.01) |

(52) U.S. Cl.
CPC ... *E04C 2/38* (2013.01); *E04C 2/46* (2013.01); *E04C 2/50* (2013.01); *E04B 5/00* (2013.01); *E04B 7/20* (2013.01); *E04B 9/0435* (2013.01); *E04H 1/00* (2013.01); *E04H 1/005* (2013.01)

(58) Field of Classification Search
CPC ..... E04C 2/38; E04C 2/50; E04C 2/46; E04B 9/0435; E04H 1/00; E04H 1/005
USPC ..... 52/262, 264, 266, 267, 271, 281, 282.2, 52/282.3, 574, 578, 590.2, 591.1, 592.1
See application file for complete search history.

(56) References Cited

U.S. PATENT DOCUMENTS

| | | | | | |
|---|---|---|---|---|---|
| 1,492,560 | A * | 5/1924 | Fisher | 446/105 |
| 3,566,561 | A * | 3/1971 | Tozer | 52/127.12 |
| 4,270,302 | A * | 6/1981 | Dandia | 446/105 |
| 6,036,398 | A * | 3/2000 | Theodorou | 403/292 |
| 6,125,607 | A * | 10/2000 | Poce | 52/847 |
| 6,604,328 | B1 * | 8/2003 | Paddock | 52/93.1 |
| 2003/0019170 | A1 * | 1/2003 | Donnelly | 52/144 |
| 2007/0245638 | A1 * | 10/2007 | Lai | 52/79.1 |
| 2011/0209436 | A1 * | 9/2011 | Fabbri | 52/762 |
| 2012/0198781 | A1 * | 8/2012 | Wrightman | 52/233 |
| 2014/0069032 | A1 * | 3/2014 | Philibert et al. | 52/79.9 |

* cited by examiner

*Primary Examiner* — Brian Glessner
*Assistant Examiner* — Paola Agudelo
(74) *Attorney, Agent, or Firm* — Ruben Alcoba, Esq

(57) ABSTRACT

A modular system for constructing flexible structures that maintain structural integrity through mostly direct frictional snap-lock engagements without requiring the modular components to slide against each other, or necessitating the need for fastening tools. The modular system may utilizes frictional channels that create a frictional snap-lock engagement to connect the modular components, and thus form the finished structure. The frictional channel connections use a direct lateral engagement to mate and hold components together. In this manner, an assortment of simple modular components can be interconnected without requiring extra space to slide the individual components against each other to interconnect. The panels have identically shaped projections and recessions that frictionally mate adjacent panels. A base frictionally interconnects with a wall panel and a floor panel. The panels take numerous shapes and orientations. A roof truss, roof base, and roof panel form the roof region for the structure.

20 Claims, 41 Drawing Sheets

180

Panel for octagon construction

MODULAR SYSTEM AND METHOD FOR CONSTRUCTING STRUCTURES

BACKGROUND

It is known that modular buildings are sectional prefabricated structures that consist of multiple sections called modules. The modules can include any number of walls, floors, ceilings, and roof components. The modular building is often prefabricated, such as in a six sided boxes constructed in a remote facility, then delivered to their intended site of use. Additionally, the modules can be placed side-by-side, end-to-end, or stacked, allowing a wide variety of configurations and styles in the building layout.

The inventor was aware that modular buildings were not always efficient to build or transport. Nor did these modular building have enough flexibility to form a wide variety of buildings. Nor were the aesthetics of the finished structures satisfactory for most consumers in the market. And the inventor realized that the individual components for the modular buildings were not perfect, often too heavy or bulky. The inventor also knew that the finished modular buildings were often flimsy, unable to withstand strong winds or earthquake type forces.

Through research and interaction with construction workers and contractors, the inventor learned that the construction of buildings and various structures for recreational or utility purposes traditionally requires the person building the structure to have at least moderate carpentry and construction skills. In addition, tools and materials such as hammers, nails, screws and screwdrivers, and saws are required. Depending on the size and scale of the project, it also can be necessary to dig holes or trenches for a foundation, mix and pour cement for that foundation. Then, upon completion of the task, the person must remove the resultant spoils and unused construction materials. All of these require significant physical effort, are time-consuming, and of significant expense.

The inventor decided to invent a modular system of buildings that utilized lightweight, yet structurally sound modular components that interconnected through frictional forces, so that a direct lateral force could mate two components together, and thus, the need for special tools and skillsets could be minimized. The inventor knew that the frictional engagement should also provide sufficient flexibility to withstand external forces playing on the panels and seams of the modular structure. The inventor also figured out that if the time in which to construct the structure could be reduced, the labor costs could also commensurately be reduced.

Through research, the inventor realized that the system should include all of the required structural components including floors, walls, ceilings, trusses, and roof elements. All of these components should be adapted to frictionally interconnect to each other. The inventor initially designed a foundation base with frictional channels that could form a supportive foundation for wall panels and floor panels through a frictional snap-lock engagement. The inventor realized that this kind of laterally direct engagement between modular components negated the need to slide the panels against the base, and thus require more space. The lateral connection reduced the need for this extra space.

Through trial and error, the inventor learned that adding projections and identically shaped recessions along the edges of the panels, and performing a frictional snap-lock engagement between them, additional structural integrity was created during the frictional interconnections. The inventor developed a double spike shape and a semicircle shape, making the peripheral edges of each shape interconnect through a frictional snap-lock engagement. These unique shapes helped the interconnections become stronger, yet still allowed for flexibility to withstand external forces.

The inventor did realize this aspect, and the modular building was suddenly more efficient. However, the inventor realized that the components were not diverse enough to build the different types and sizes of structures that the markets demanded. So the inventor continued diversifying the shapes and dimensions of the panels, adding a curved panel, an apex panel, an L-shaped panel, a T-shaped panel, and panels that created hexagonal shaped structures. The capacity to include lighting, staircases, and shingles was also integrated into the modular system so that the system could be used both indoors and outdoors.

Systems and methods for constructing modular buildings have been used for building quickly and efficiently in the past, yet none with the present characteristics of the present invention. See Patent numbers: U.S. 20120247043; U.S. 20130086850; U.S. Pat. No. 8,065,846 and U.S. Pat. No. 3,455,075.

For the foregoing reasons, there is a need for a system and method for constructing modular structures through a frictional snap-lock interconnection that minimizes the need for tools and sliding the components against each other.

SUMMARY

The present invention is directed to a modular construction system that forms flexible structures that maintain structural integrity through lateral frictional snap-lock interconnections between individual building components without requiring the components to slide against each other, or necessitating the need for special tools for fastening. In some embodiments, the modular system may utilizes frictional channels that create a frictional snap-lock engagement to connect the modular components, and thus form the finished structure. The frictional channel connections use a direct lateral engagement to mate and hold components together. In this manner, an assortment of simple modular components can be interconnected without requiring extra space to slide the individual components against each other to interconnect.

The system comprises eclectic shapes and dimensions of modular building components, including, without limitation, a series of panels, bases, dividers, roof trusses, roof bases, and holes that can be configured into numerous structural designs. The components are connected in a particular configuration which permits multiple modular components to be mounted together in horizontal and vertical arrays. Each component may have a frictional channel that mates with a corresponding frictional channel from another component. The frictional channels are pre-cut in the components to allow for efficient mating through the frictional snap-lock engagement, or for connectors to seat in the frictional channels of adjacent members forming a clean joint between two channeled components.

In some embodiments, the modular system can also utilize fasteners, such as screws and bolts, to reinforce the frictional connections. Assembly in this fashion provides a friction fit and achieves substantial stability. This stability is present in completed and partially assembled structures, allowing whole projects or sections thereof to be moved during construction with minimal risk of structural collapse. However, the panels don't allow the fastener to pass all the way through. The thread that accepts the screw is made in the same panel.

Additionally, conduits may extend through the length of the panels, bases, dividers, roof trusses, roof bases, and holes, and conduits to enable passage of wiring, water lines, gas lines, and other habitual necessities. In some embodiments, the system supports the possibilities of a wide variety of configurations and specialty members, which may be added to effect distinct characteristics, features, and functionality.

The modular system for constructing a structure through frictional mating comprises: a base defined by a pair of channel sides and a pair of tongue sides. The base is generally elongated and has a substantially rectangular cross section. Each channel side on the base has two base protrusions that extend along the length of the base. The base protrusions provide surface area for support and rigidity. A base frictional channel forms between the two base protrusions. The base frictional channel is sized and dimensioned to generate friction when a panel is engaged within. The two base protrusions include a plurality of base apertures that form a transverse axis across the two base apertures. The base apertures enable passage of fasteners for providing additional structural integrity. Additionally, each tongue side defined by a tongue that extends along the length of the base. The tongue forms a supportive surface for holding up panels.

The system further comprises a wall panel defined by a plurality of wall panel edges. The wall panel edges are arranged to mate with the frictional channel in a frictional snap-lock engagement. At least one of the wall panel edges is defined by at least one wall projection that extends laterally. An example of the at least one wall projection can be a double-spike shape. At least one of the wall panel edges is also defined by at least one wall recession that recesses laterally. An example of the at least one wall recession can be a recessed double-spike shape that is identically shaped to the double-spike to create a corresponding mating surface. In this manner, the at least one wall projection is arranged to mate with the at least one wall recession of an adjacent wall panel in a frictional snap-lock engagement. Additionally, the wall panel is defined by at least one wall conduit used to carry wiring, water pipes, or gas lines.

The system further comprises a floor panel that provides a flat walking and/or supporting surface. The floor panel is defined by a plurality of floor panel edges. The floor panel edges are arranged to engage a junction that forms between the tongue and each protrusion. At least one of the floor panel edges is defined by at least one floor projection that extends laterally. An example of the at least one floor projection can be a semicircle shape. At least one of the floor panel edges is also defined by at least one floor recession that recesses laterally into the floor panel. An example of the at least one floor recession can be a recessed semicircle shape that is identically shaped to the semicircle shape to create a corresponding mating surface. In this manner, the at least one floor projection is arranged to mate with the at least one floor recession of an adjacent floor panel in a frictional snap-lock engagement. Additionally, the floor panel is defined by at least one floor conduit used to carry wiring, water pipes, or gas lines.

The system further comprises a divider that separates upper and lower floors in the structure. The divider is defined by a divider first side having a first frictional channel and a divider second side having a second frictional channel. The divider first side and the divider second side are arranged to support the plurality of floor panels. In this manner, a floor panel can rest on the first side, above the divider. Another floor panel can rest on the second side, below the divider. A first and second floor to a structure is thus formed. The first frictional channel and the second frictional channel are arranged to mate with the plurality of wall panel edges in a frictional snap-lock engagement. In this manner, a wall panel mates with the first frictional channel from above the divider, and another wall panel mates with the second frictional channel from beneath the divider. The wall panel and the floor panel meet in a substantially perpendicular orientation at the divider.

The system further comprises a roof truss defined by a generally arc shape. The arc shape of the roof truss helps carry off debris, such as rain and snow from the apex of the structure. The roof truss is further defined by a pair of lateral ends. Each lateral end has a roof frictional channel that is sized and dimensioned to create the frictional snap-lock engagement with other components, such as panels. The roof truss also has a plurality of roof apertures extending along the edges of the pair of lateral ends. The roof apertures enable passage of fasteners for securing panels to the roof truss.

The system further comprises a roof panel arranged to mate with the roof frictional channel in a frictional snap-lock engagement. The roof panel is defined by a plurality of roof panel edges. The roof panel frictionally attaches to the roof frictional channel from one edge, and rests on a roof base from an opposite edge. The roof base is defined by a generally rectangular block that provides structural integrity. A roof base frictional channel rests adjacently to the roof base. The roof base frictional channel mates with the roof panel in a frictional snap-lock engagement.

One objective of the present invention is to construct a structure with a minimal amount of tools and fasteners.

Another objective is to leverage the structural integrity of the structure with compressive forces and frictional snap-lock engagement, such that panels, dividers, trusses, and bases form a solid construction.

Another objective is to create sufficient flexibility between the frictional connections in the panels, dividers, and bases, such that the structure dampens vibrations caused by an earthquake and can withstand strong winds, tidal waves, and explosive reverberations.

Another objective is to provide a panel that connects to an adjacent panel without requiring one panel to slide across the edge of another. Rather the panels can mate directly into a frictional snap-lock engagement. This eliminates the need for extra space above and below the panels for sliding together.

Another objective is to provide flexibility of design to carry wires, water pipes, and gas lines through the panels, dividers, bases, and roof trusses.

Another objective is to enable the entire structure to be disassembled and moved without the use of heavy equipment.

Another objective is to enable easy storage of the individual pieces during disassembly of the structure.

Yet another objective is to provide expandability in order to incorporate new components and create large projects.

DRAWINGS

These and other features, aspects, and advantages of the present invention will become better understood with regard to the following description, appended claims, and drawings where:

FIG. 4A is shows both first sides truncated, and FIG. 4B shows the right side truncated;

FIG. 5A is shows both first sides truncated, and FIG. 5B shows the right side truncated;

FIG. 10A shows the roof truss with roof apertures, and FIG. 10B shows the roof base connected to the roof truss through an exemplary roof panel;

Figure 12A:
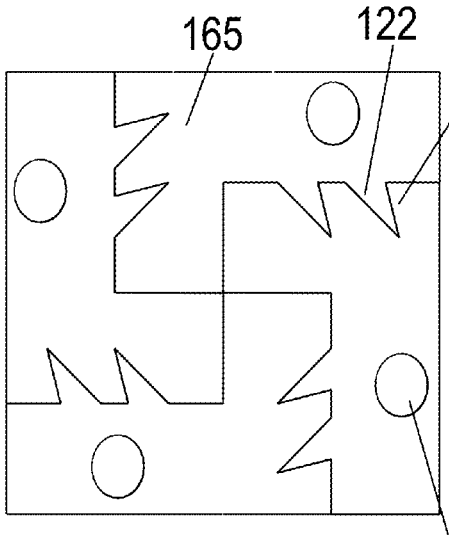
Figure 12B:
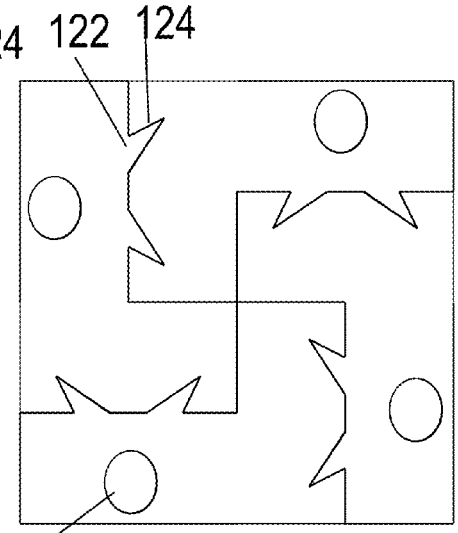
Figure 12C:
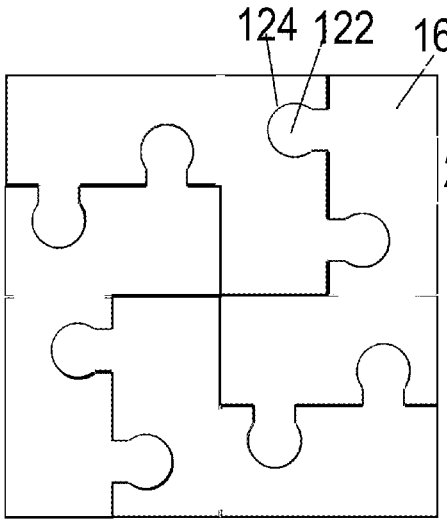
Figure 12D:
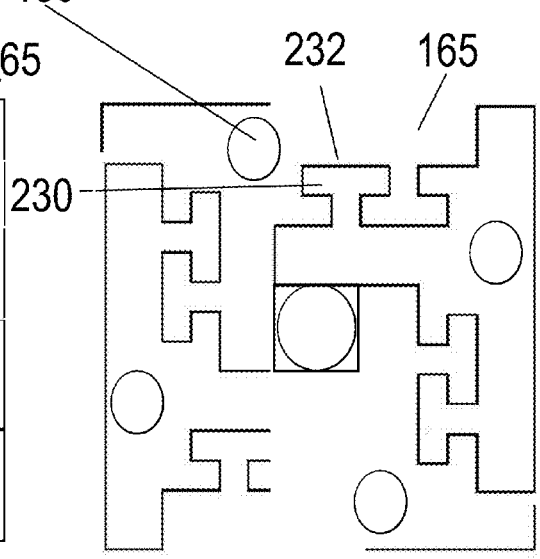
Figure 13:
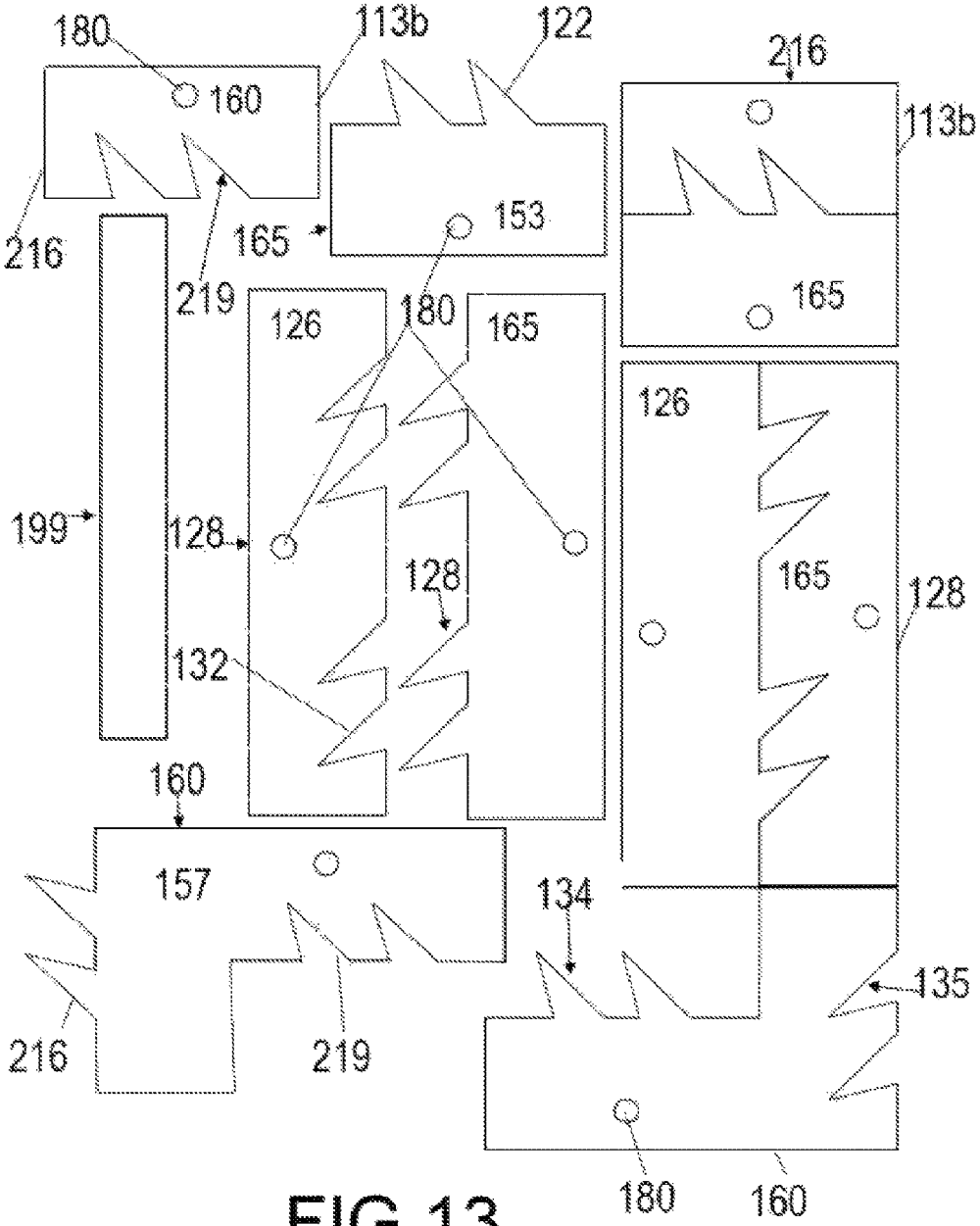
Figure 14:
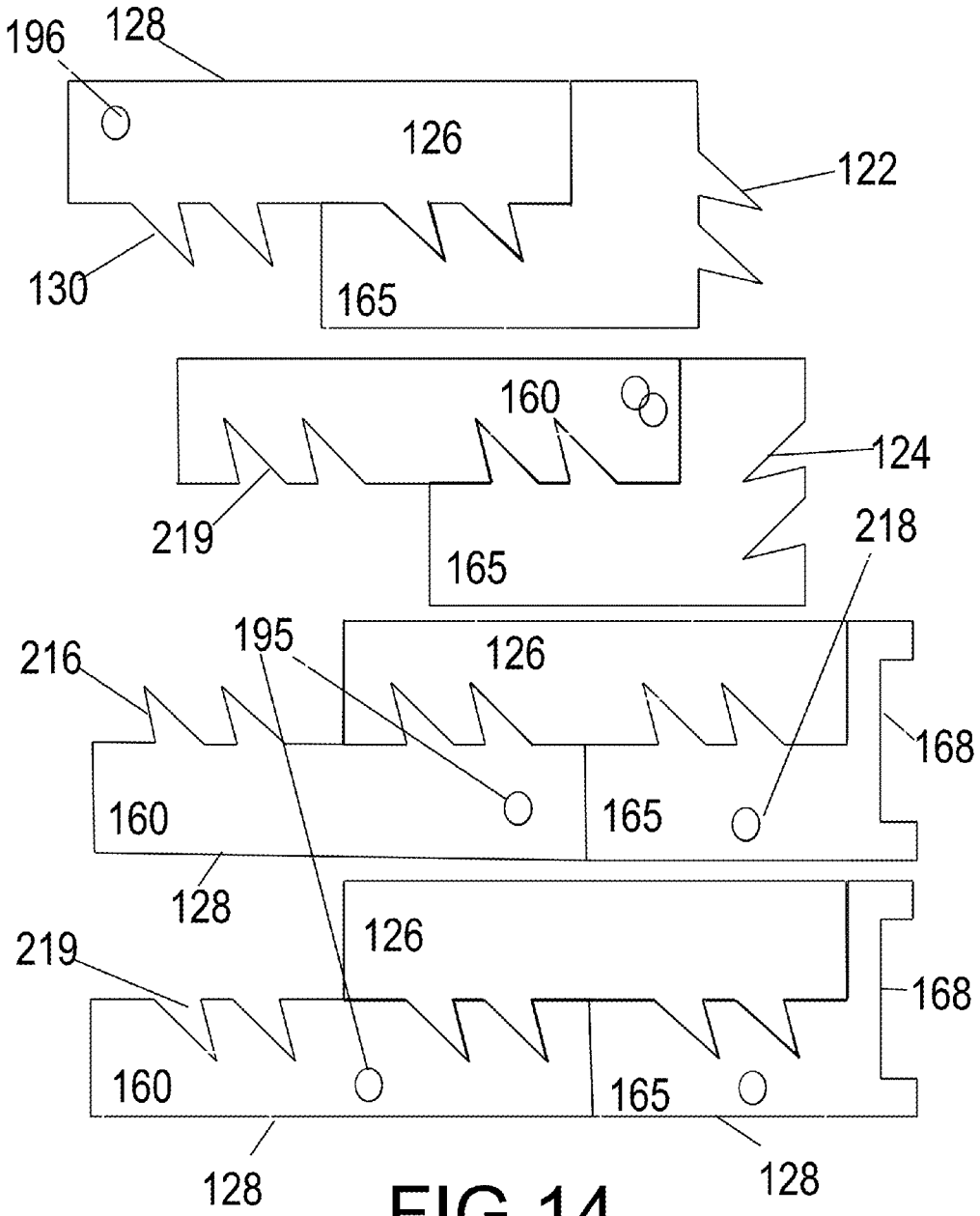
Figure 15:
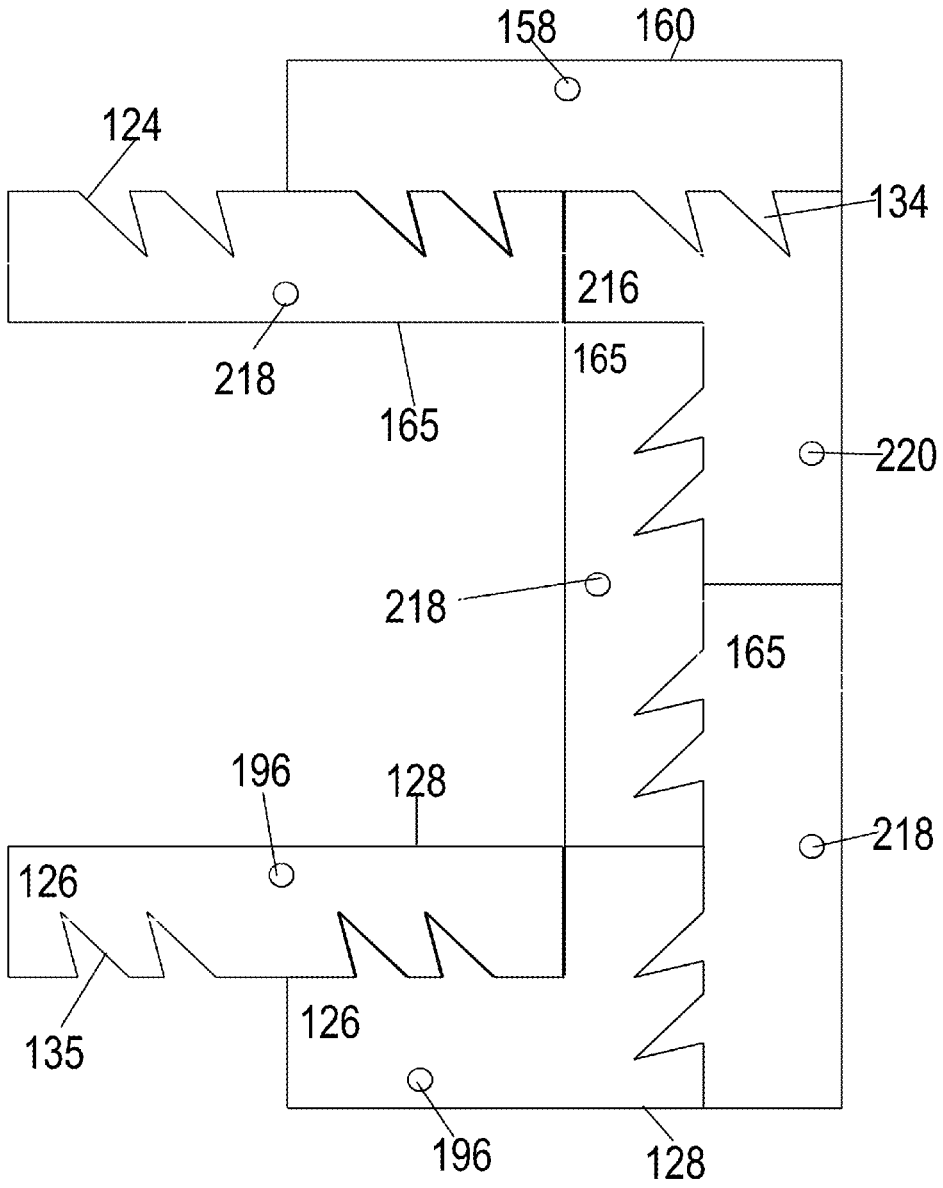
Figure 16:
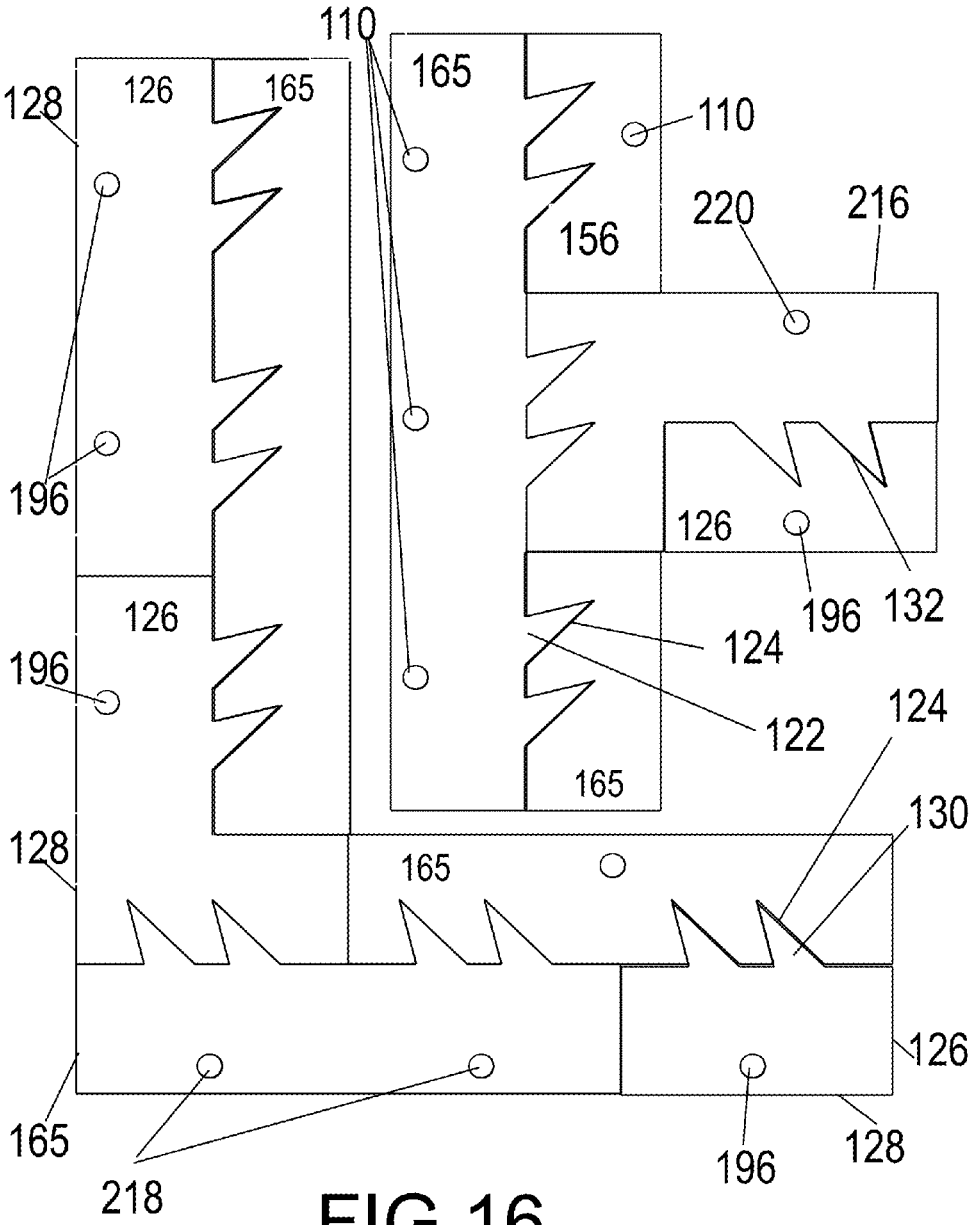
Figure 17:
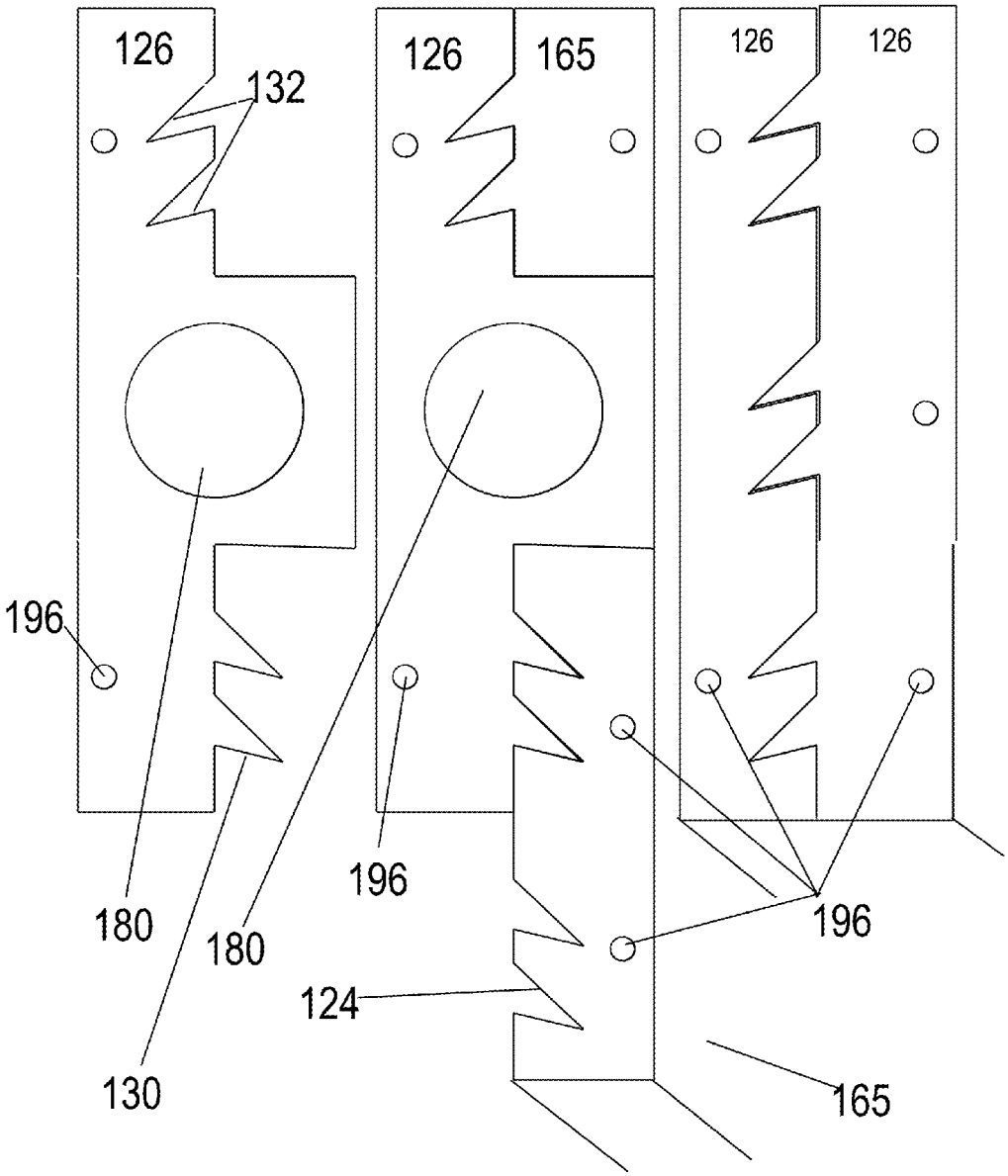
Figure 18A:
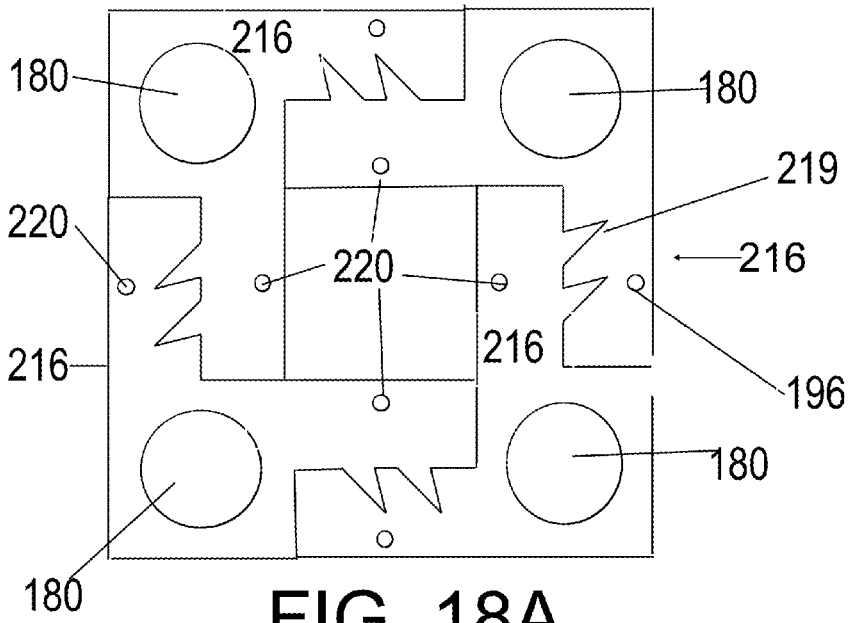
Figure 18B:
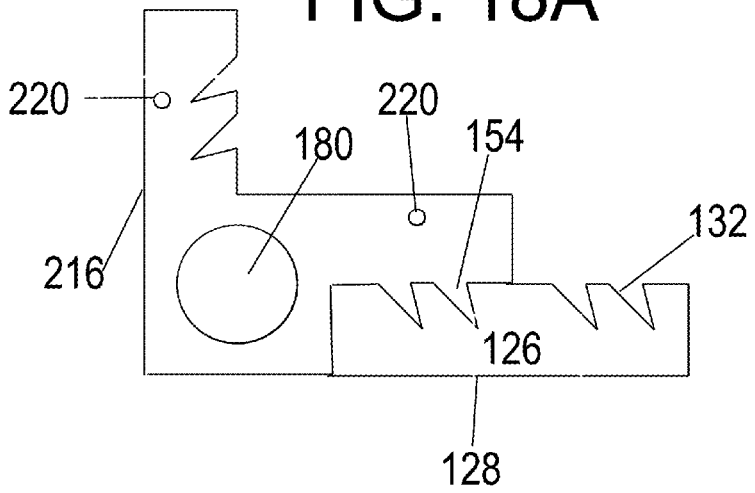
Figure 19A:
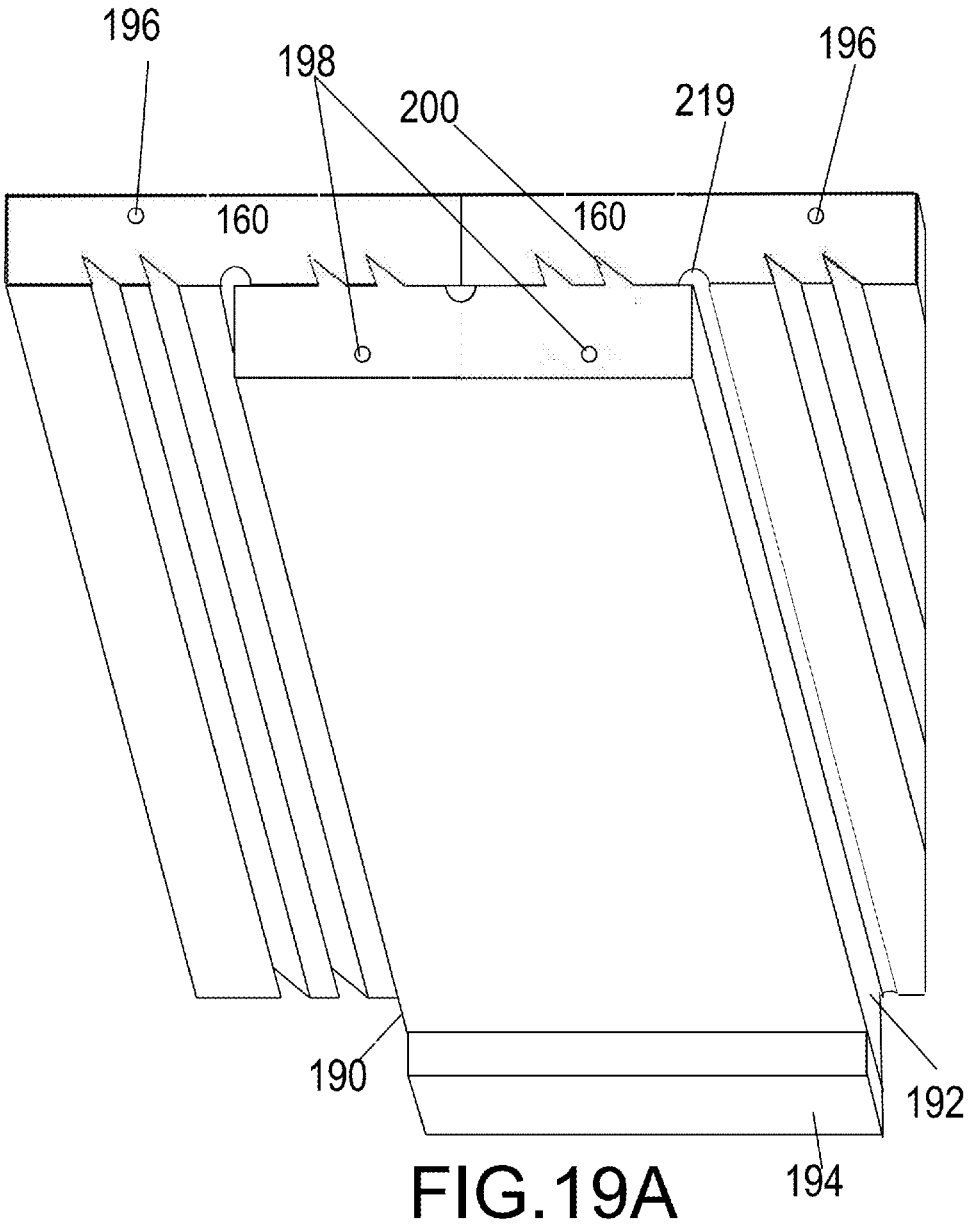
Figure 19B:
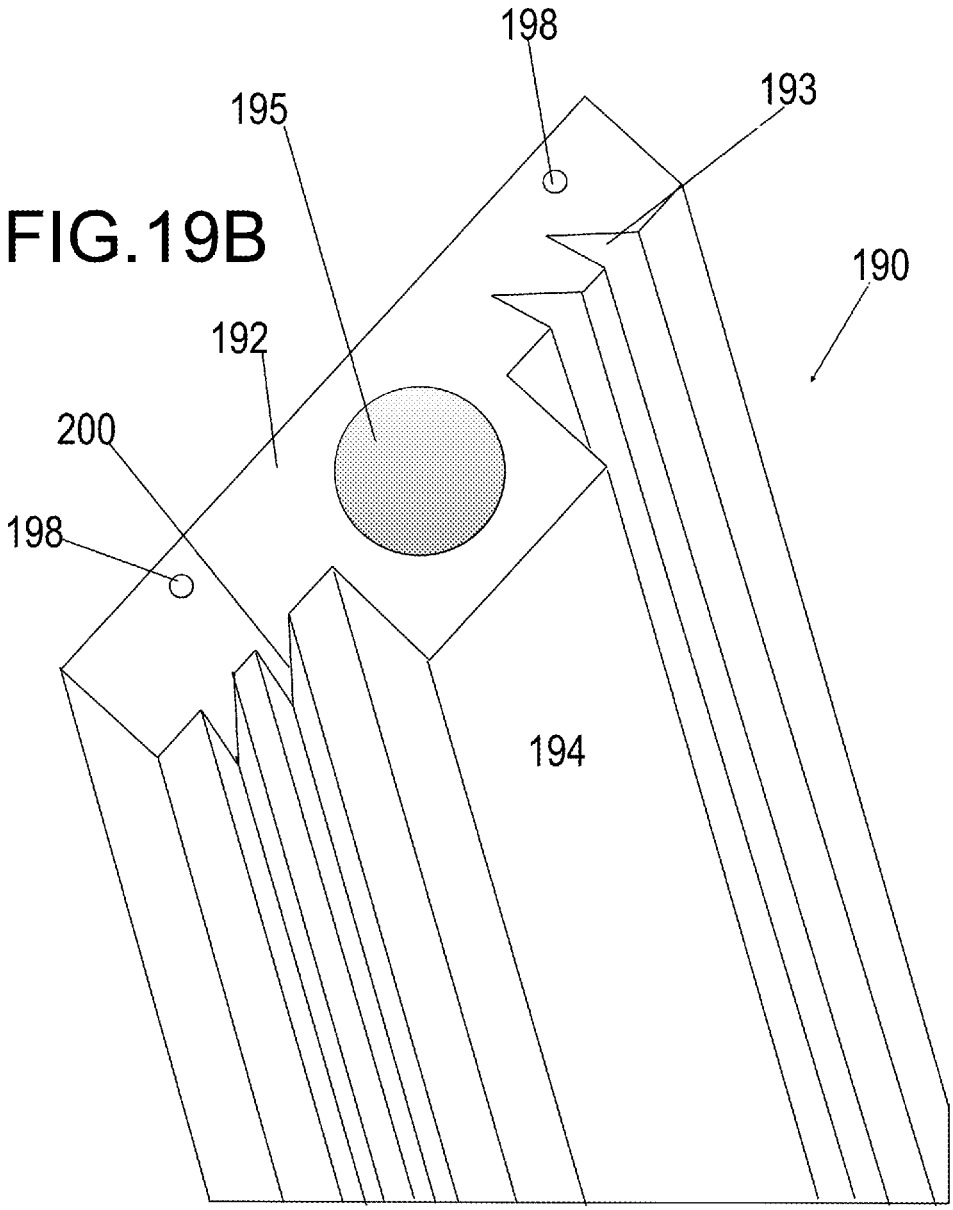
Figure 20:
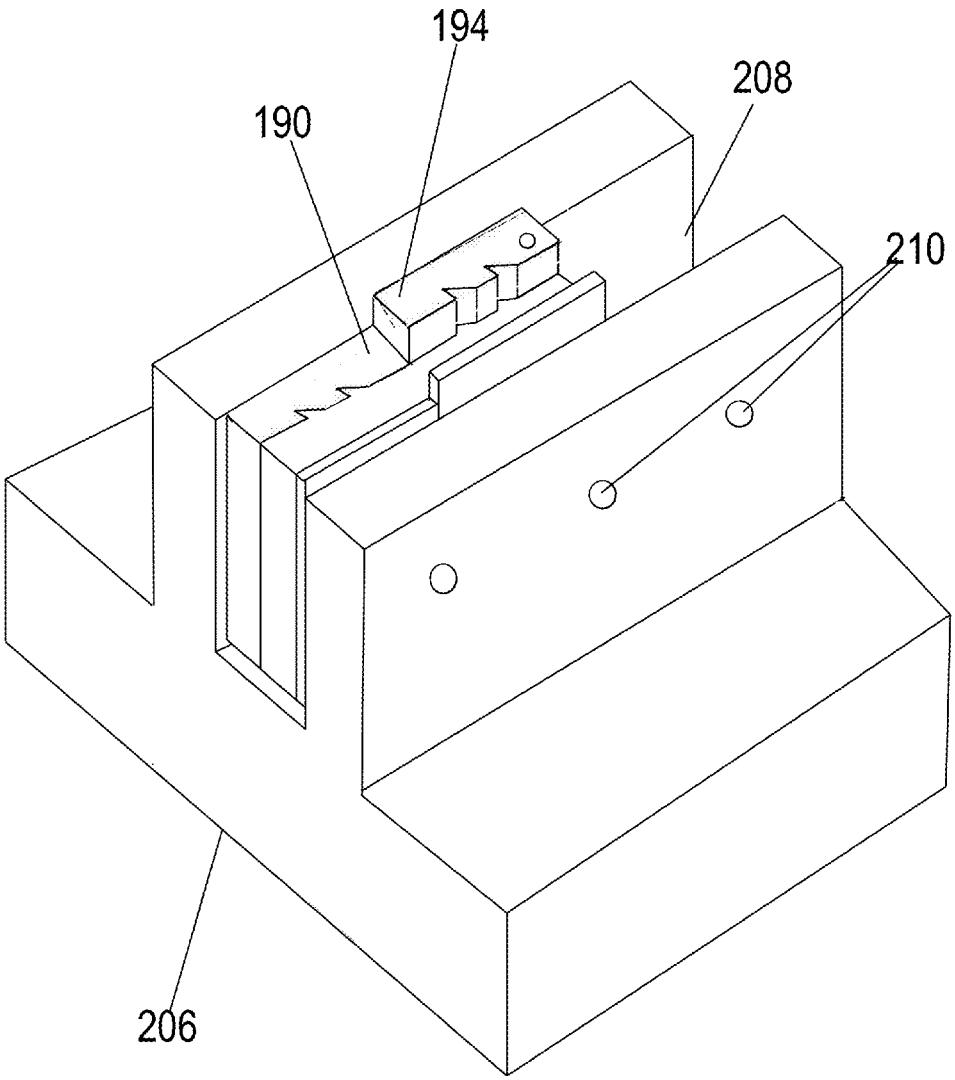
Figure 21A:
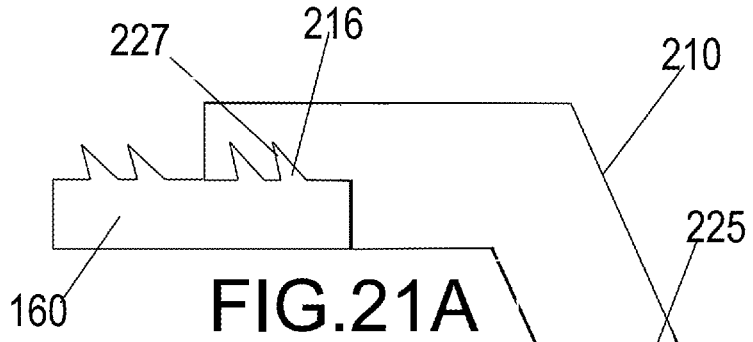
Figure 21B:
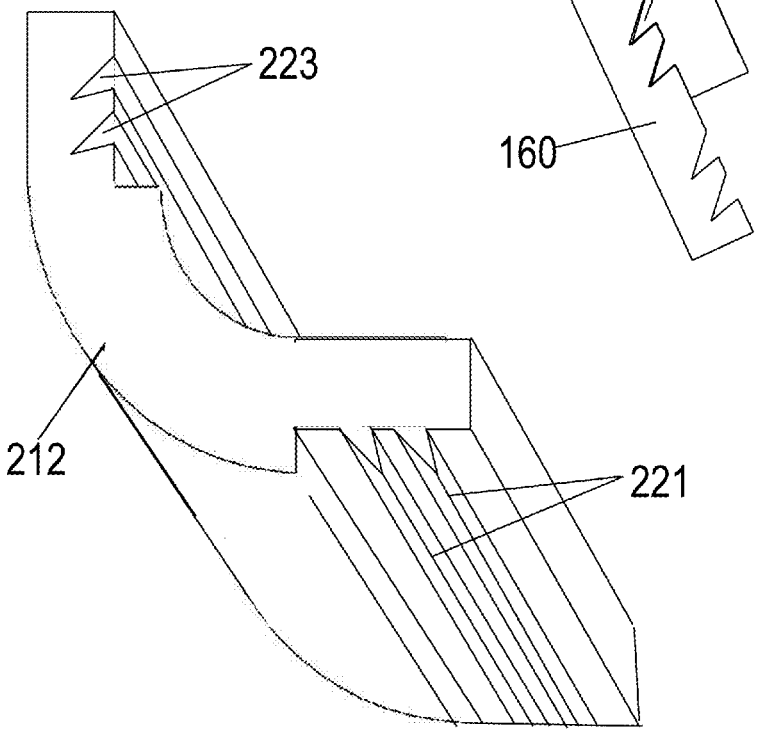
Figure 22:
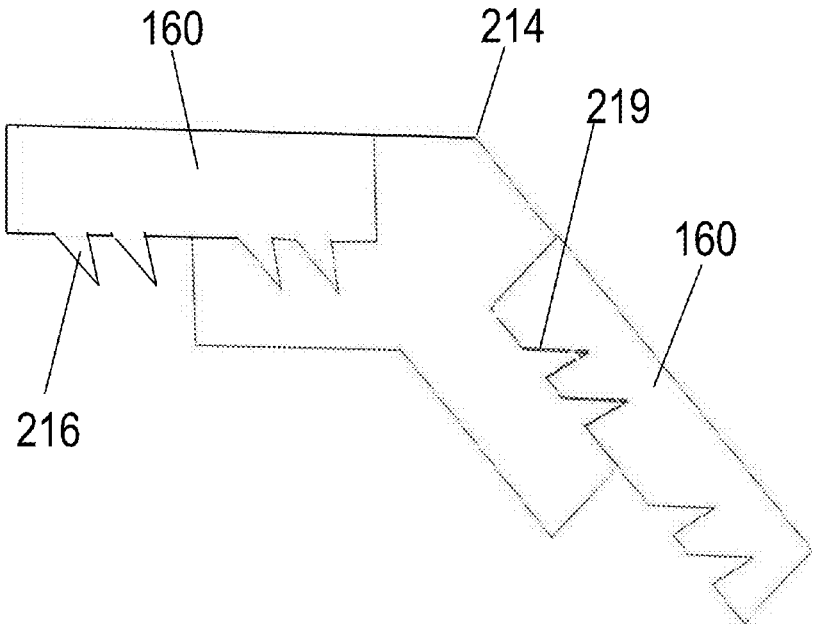
Figure 23:
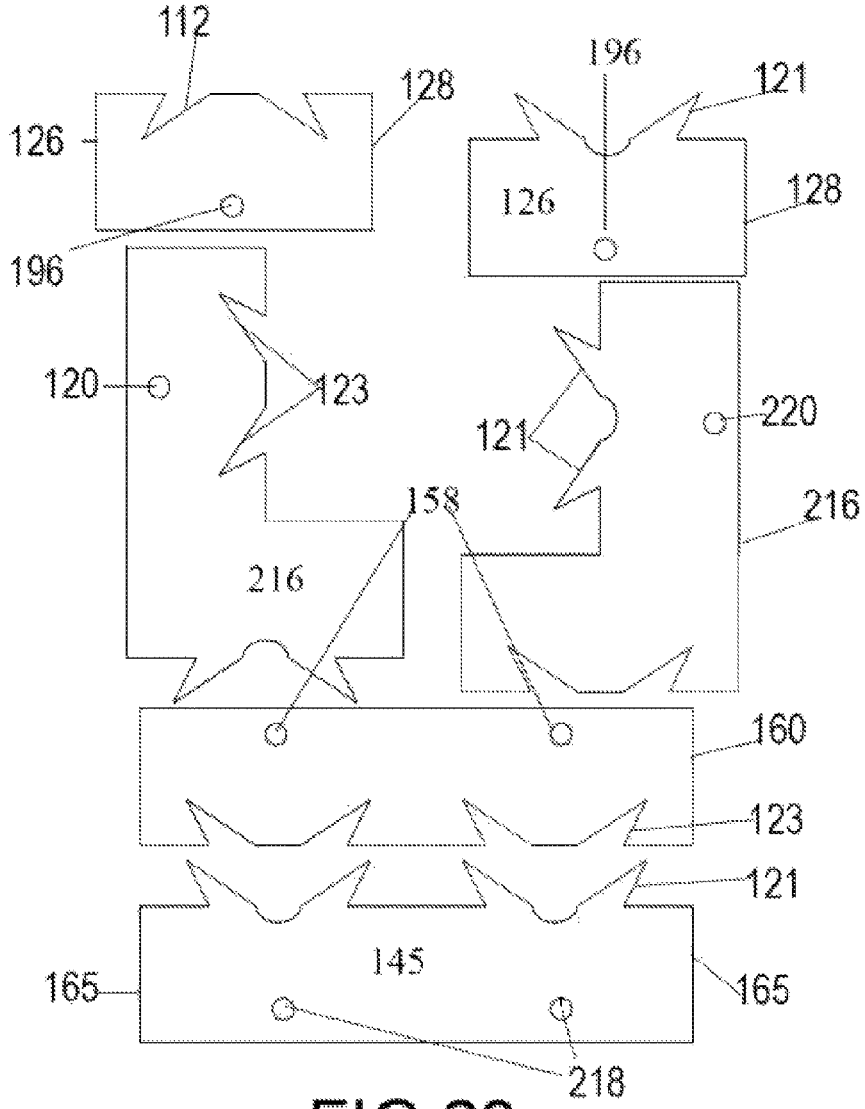
Figure 24:
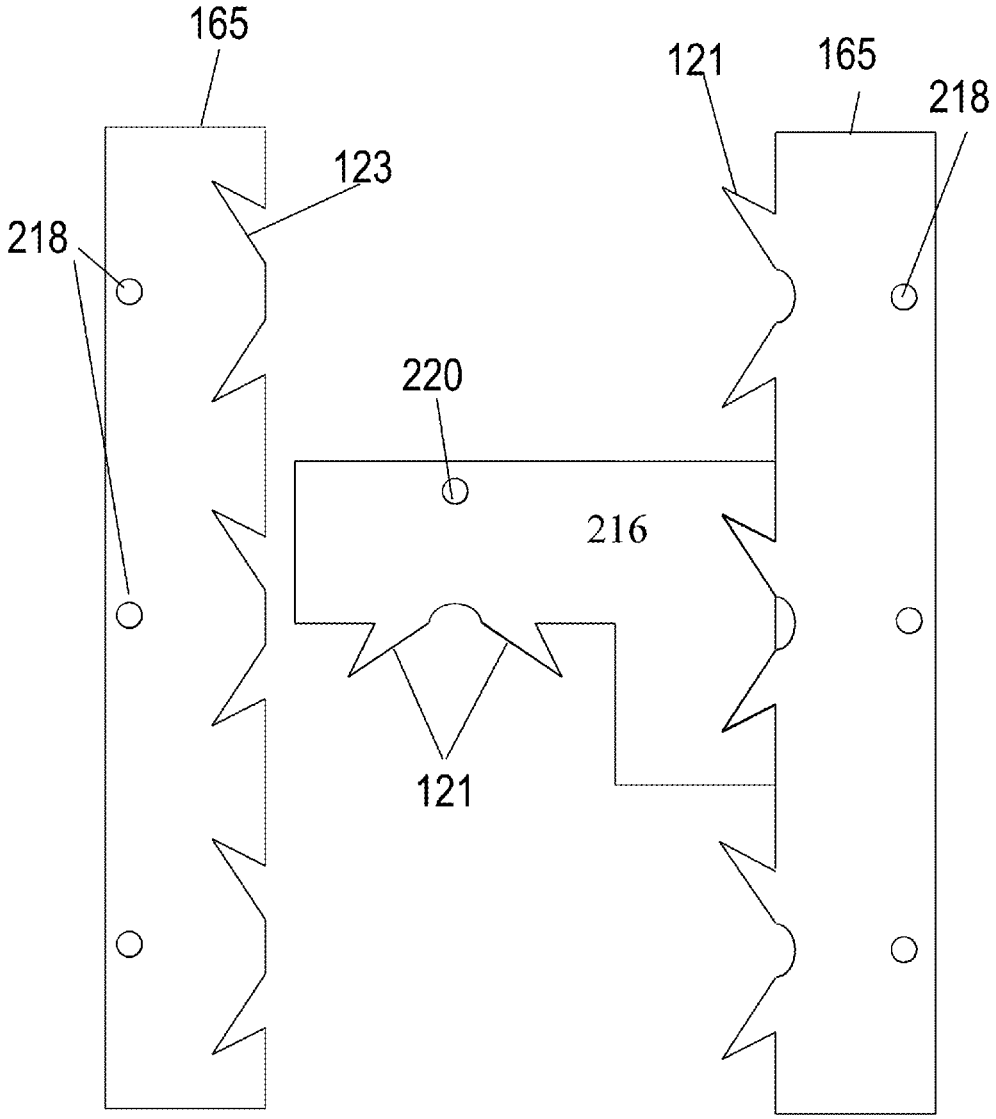
Figure 25A:
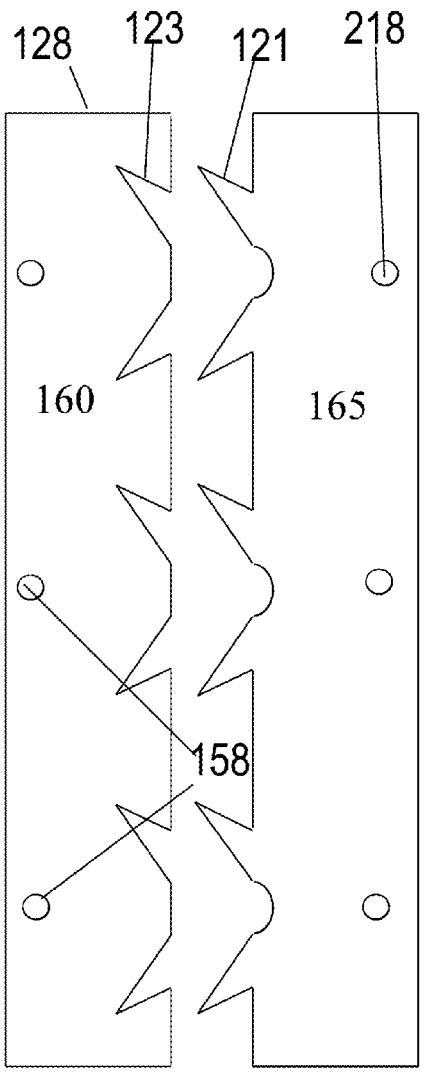
Figure 25B:
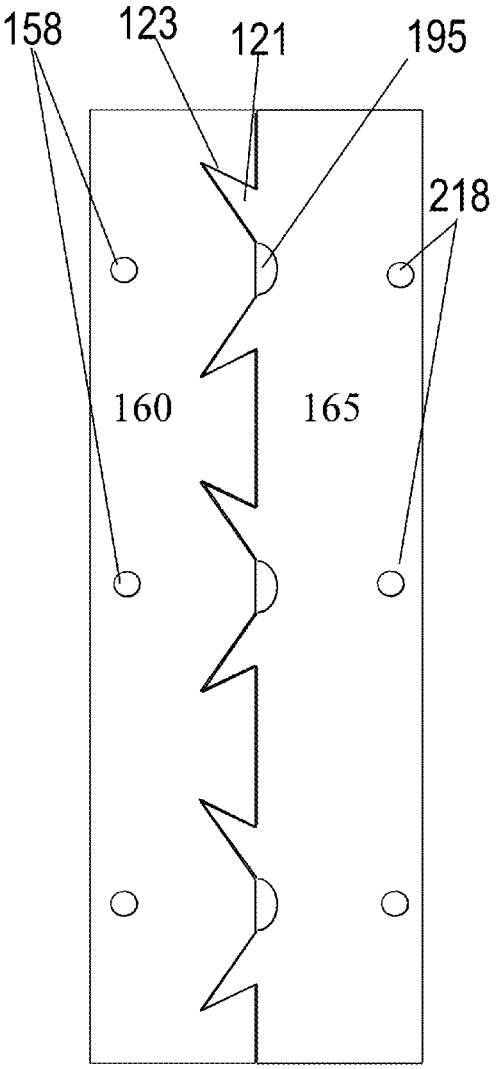
Figures 26A, 26B:
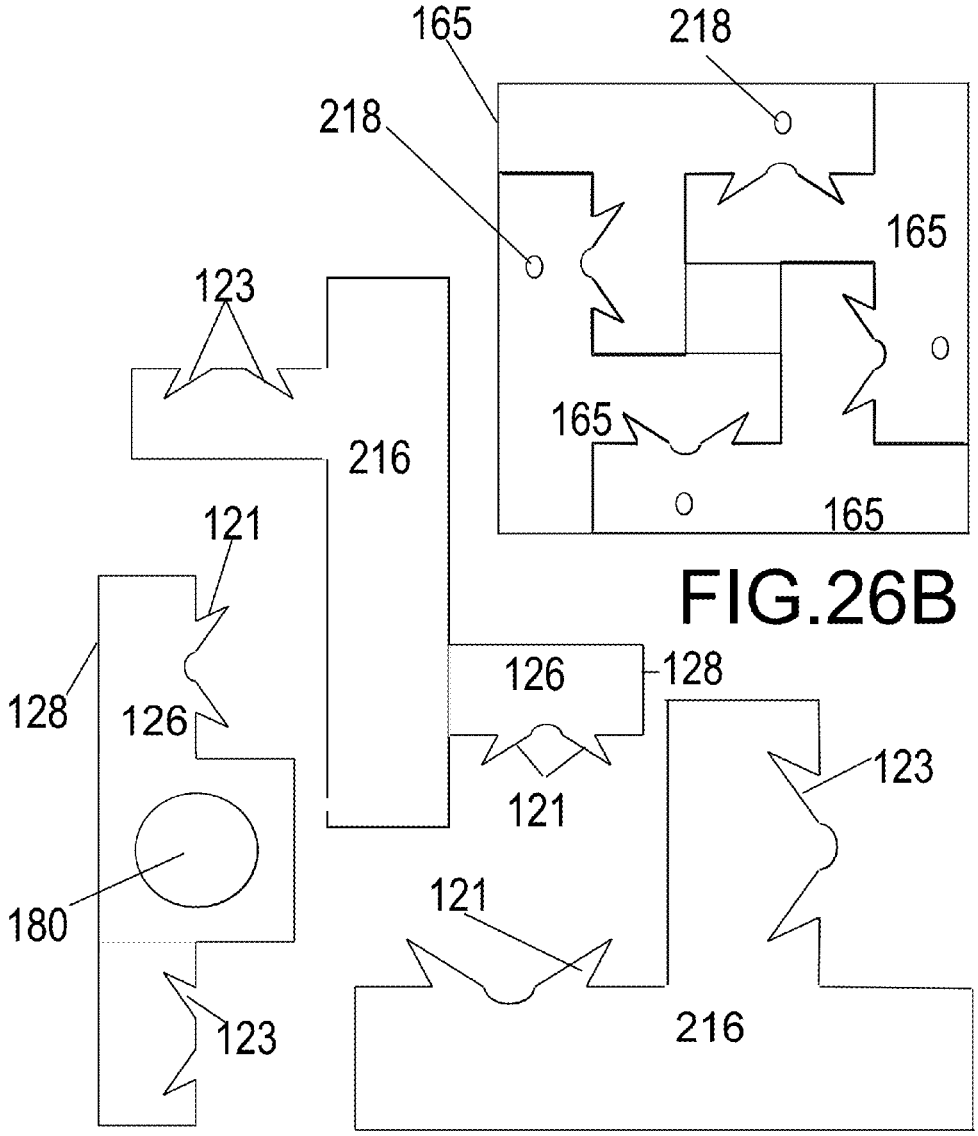
Figure 27:
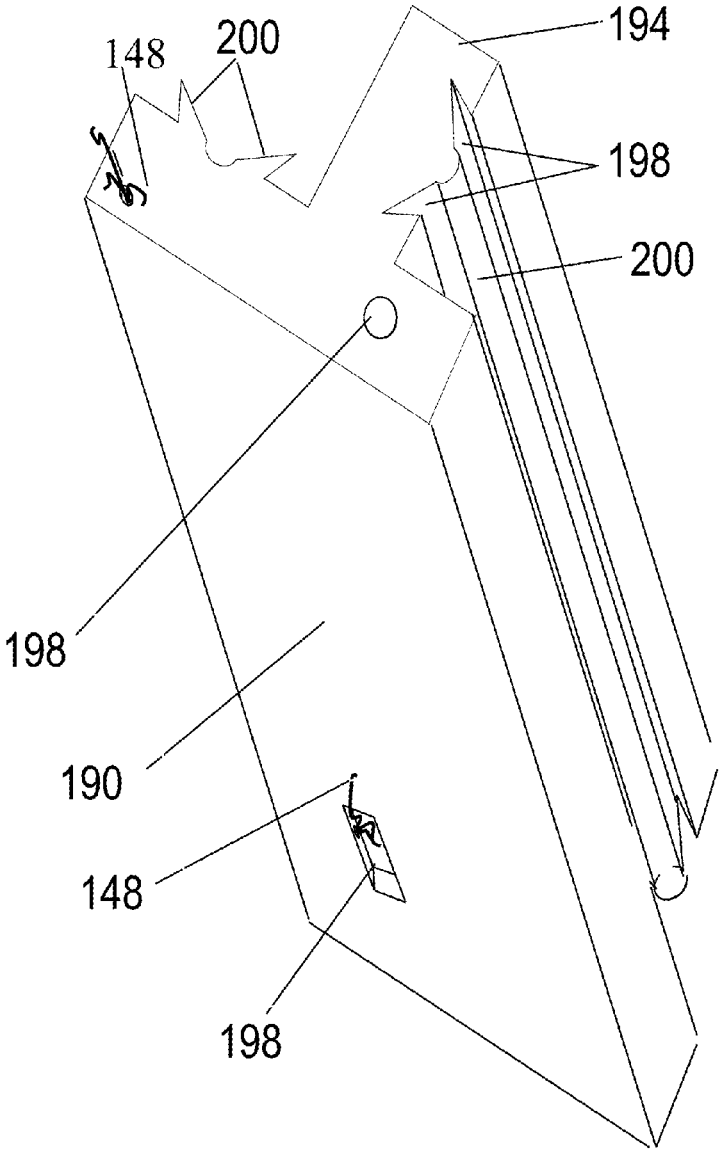
Figure 28A:
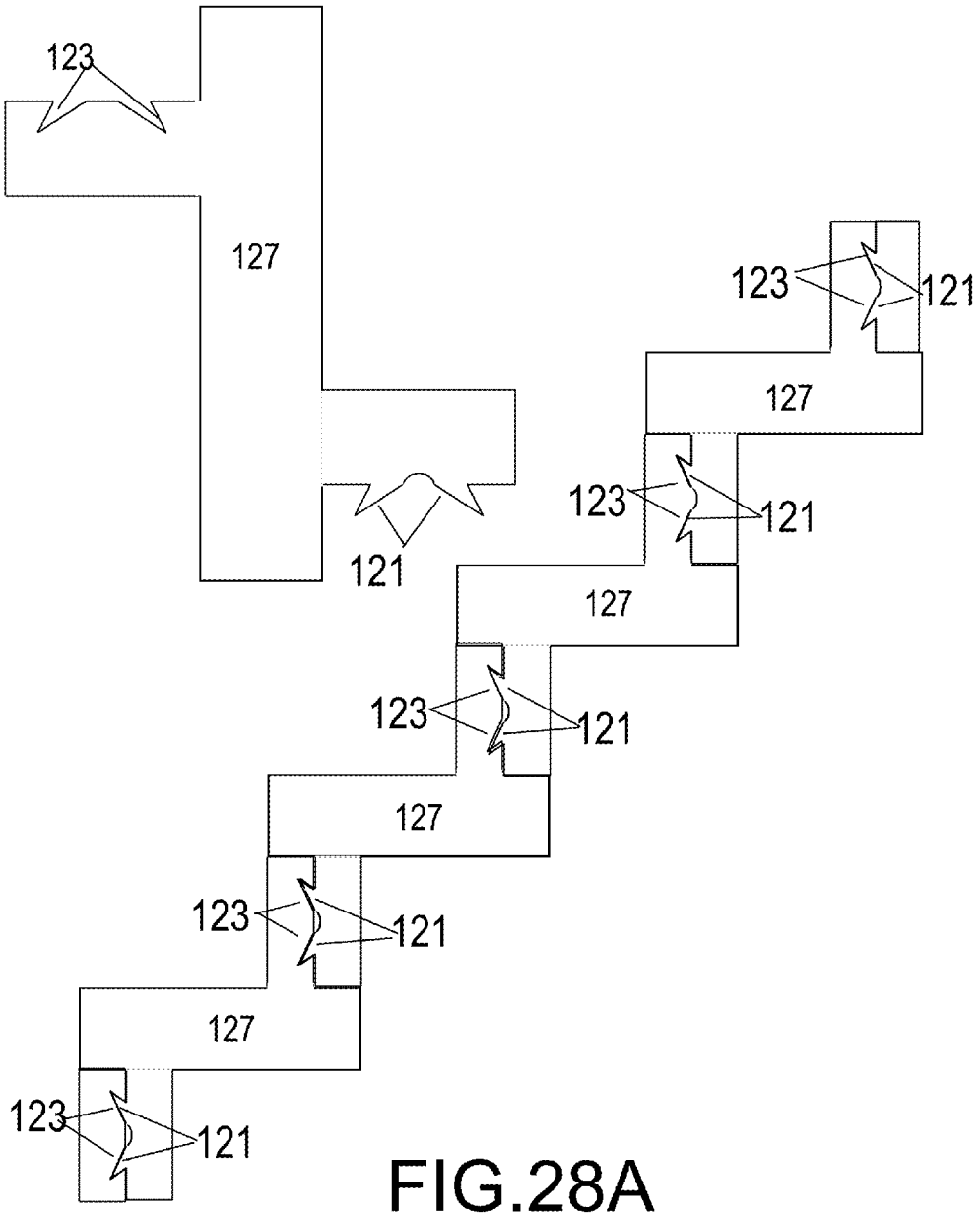
Figure 28B:
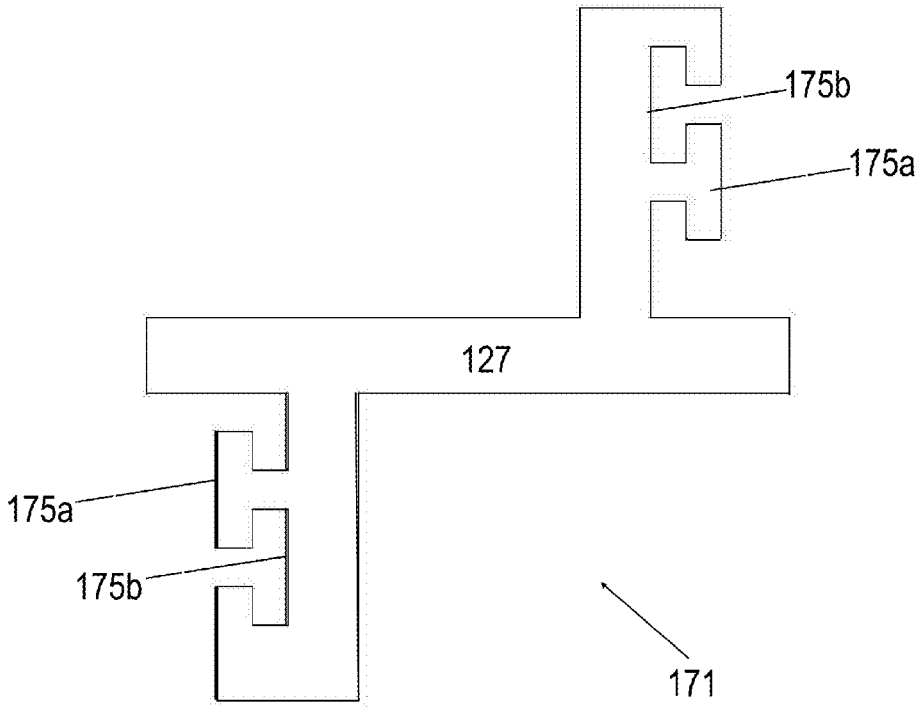
Figure 29:
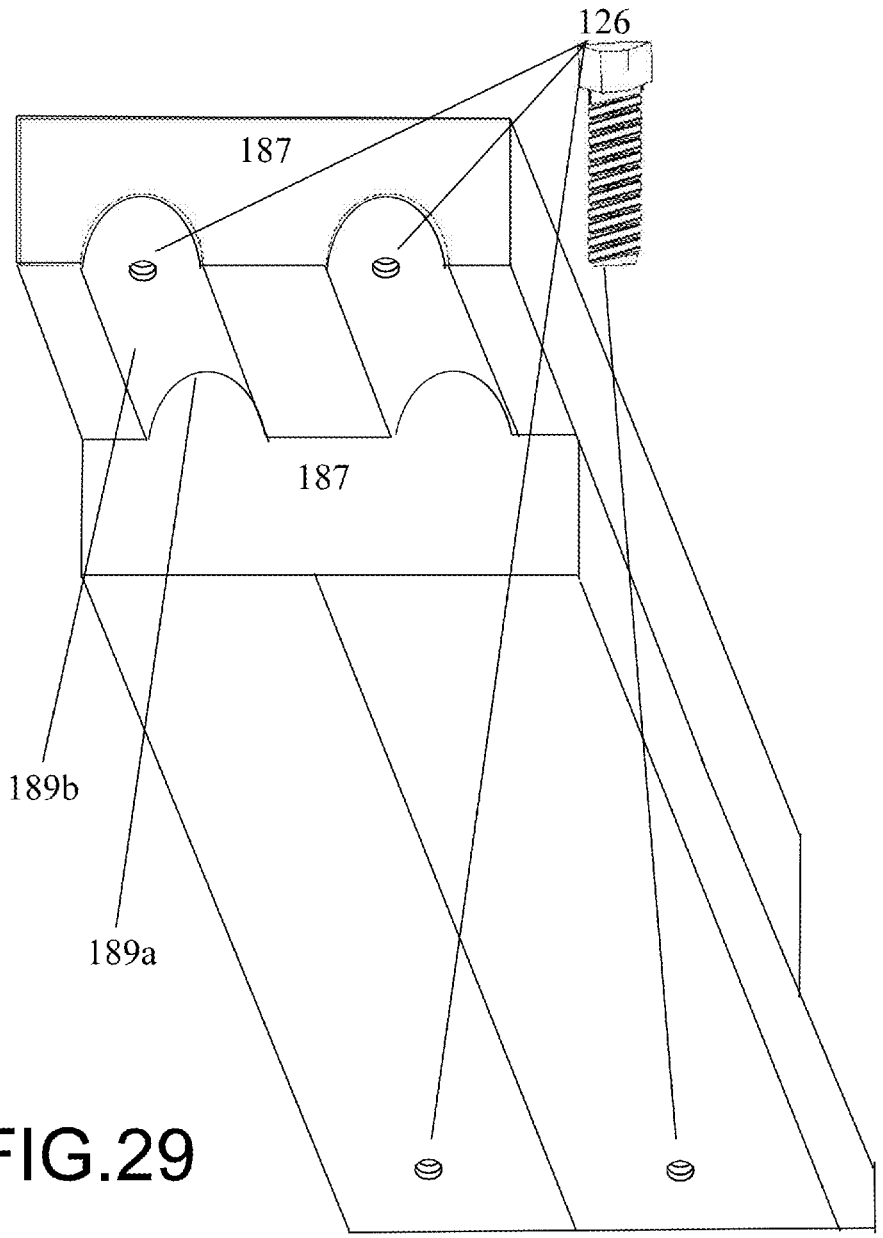
Figure 30:
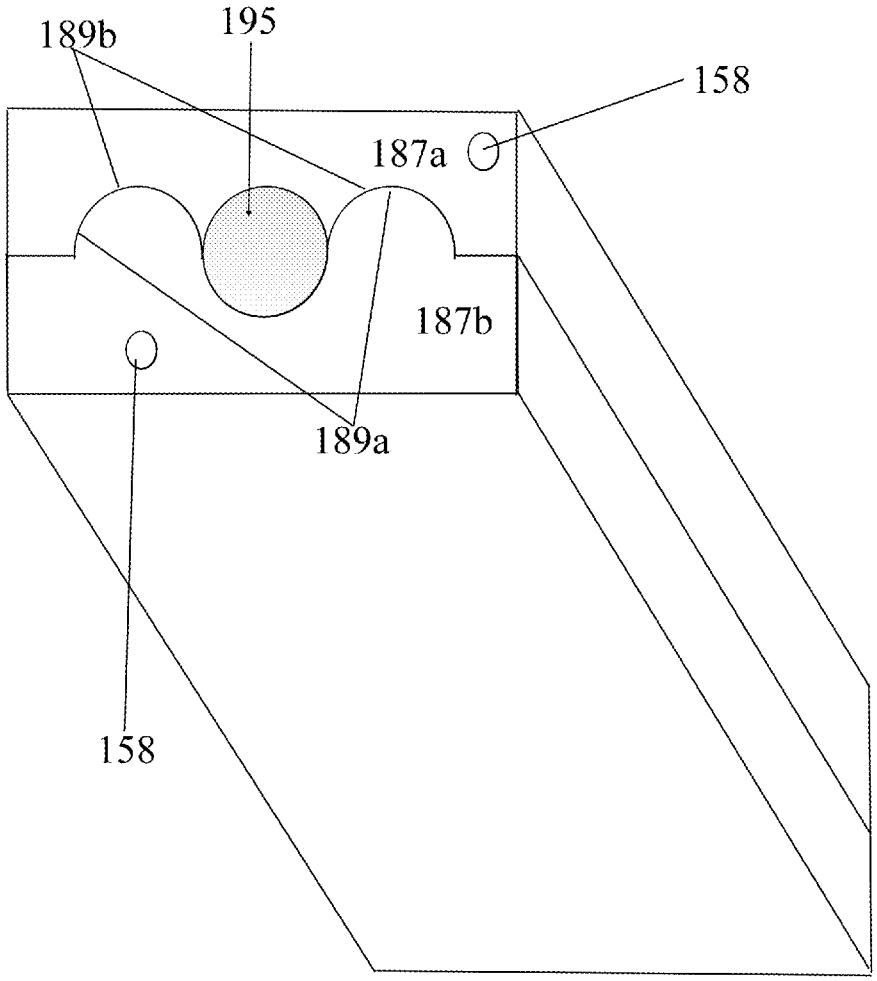
Figure 31:
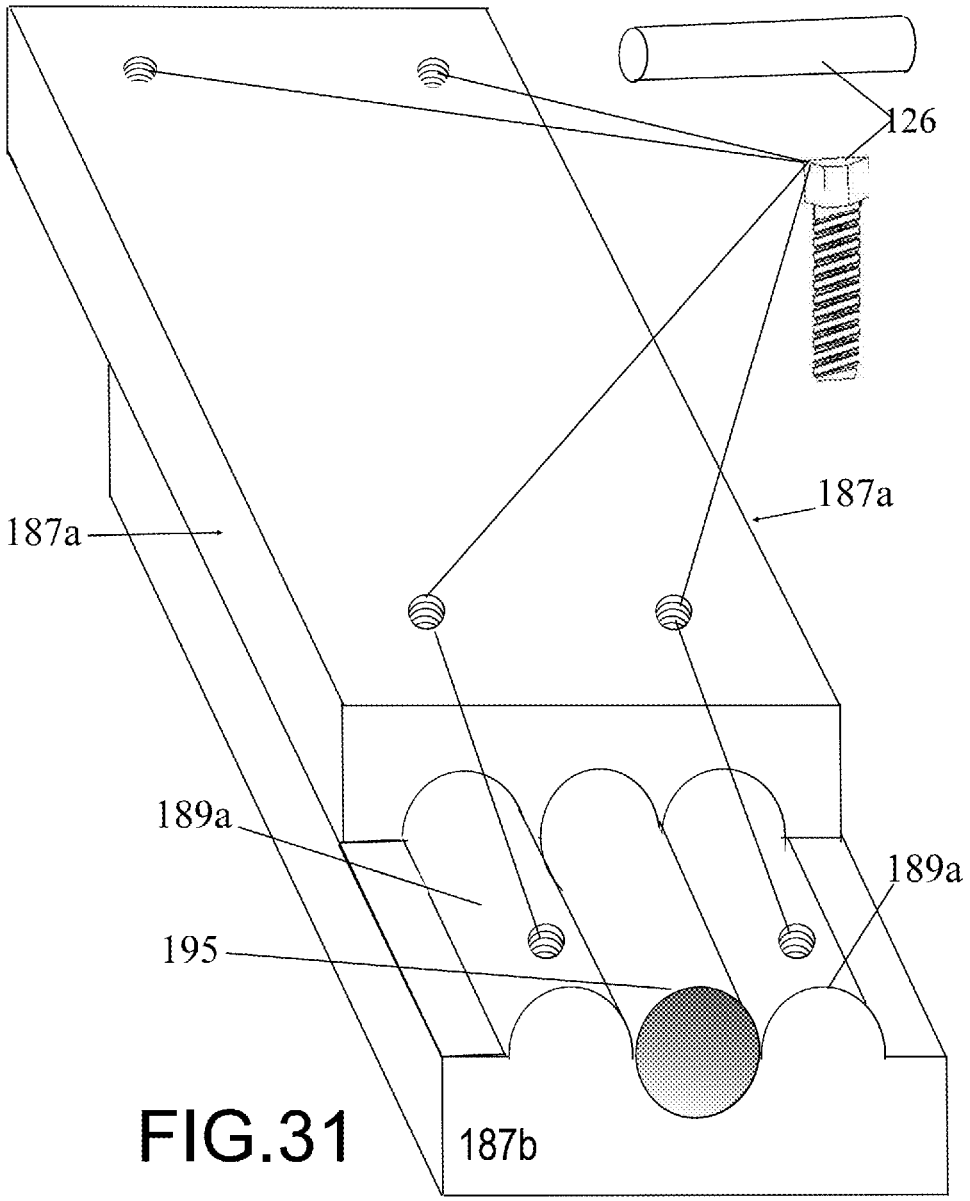
Figure 32C:
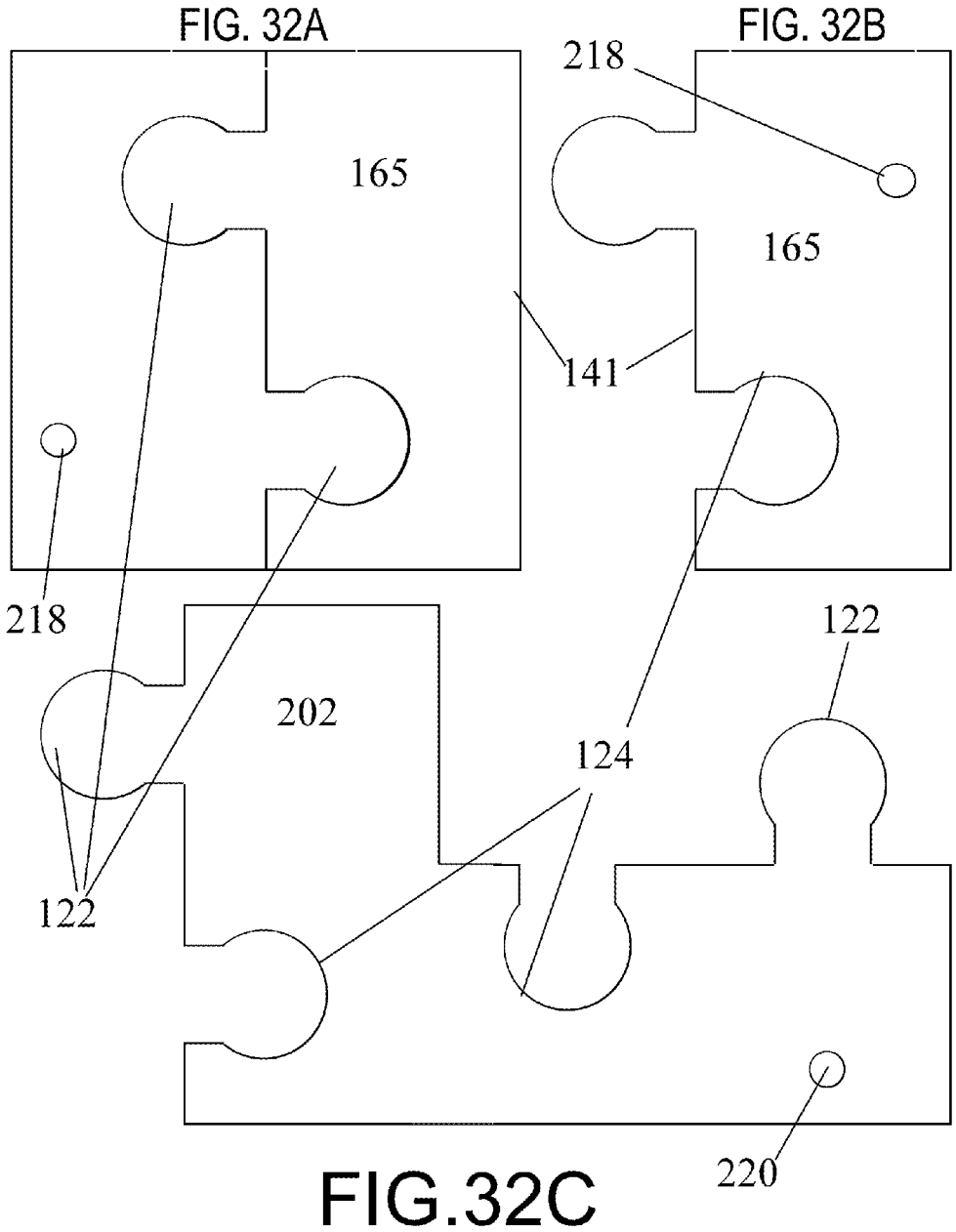
Figures 33A, 33B:
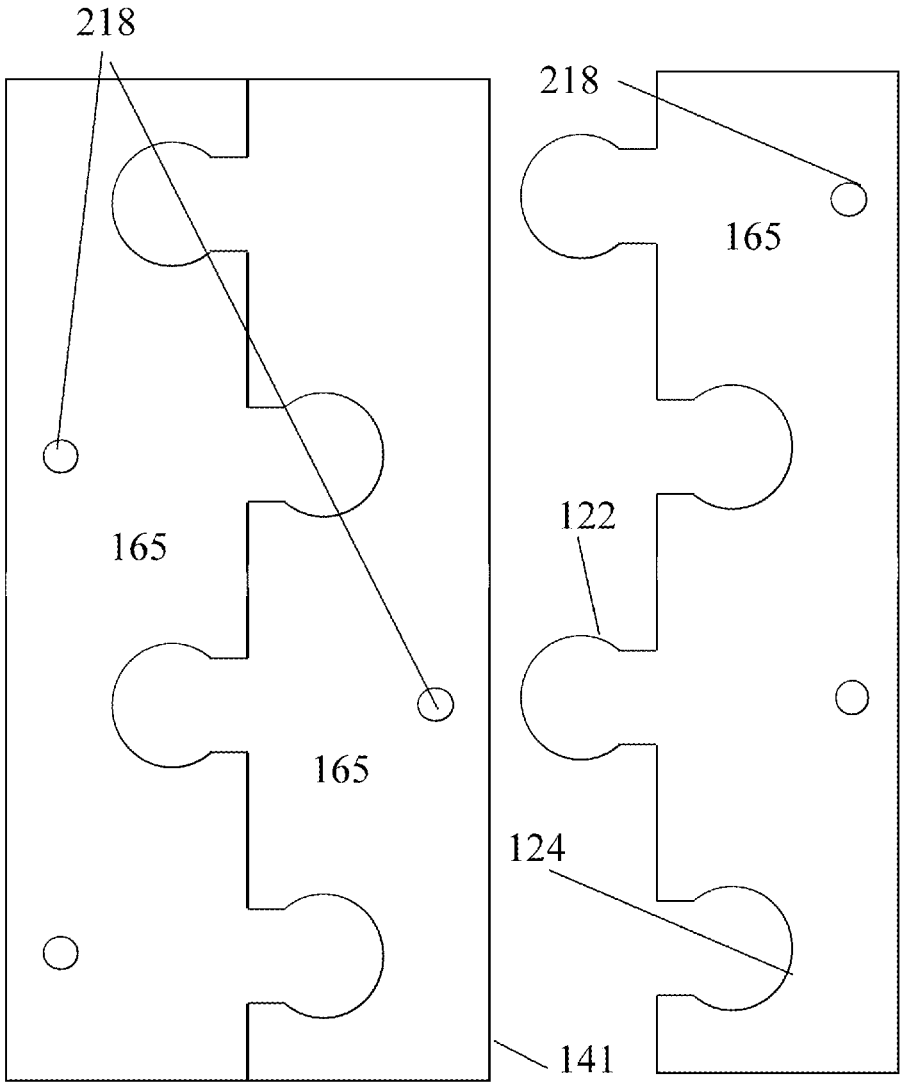
Figure 34:
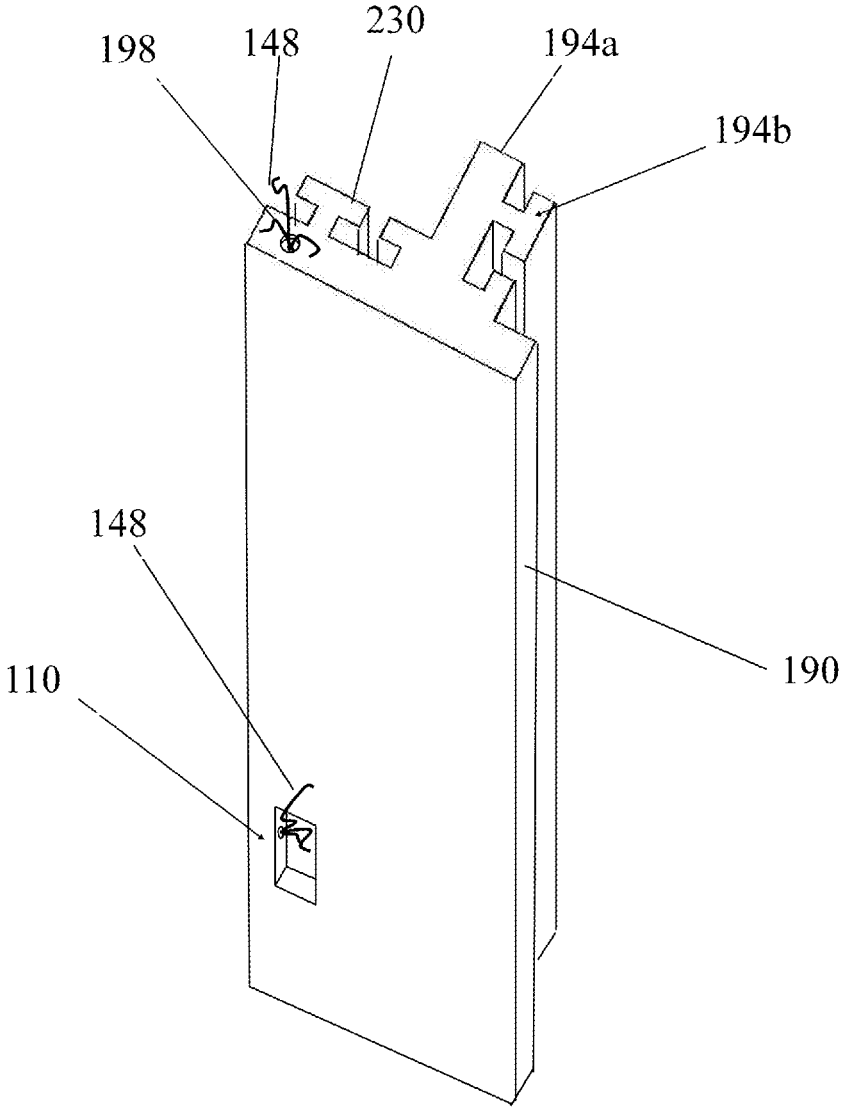
Figure 35:
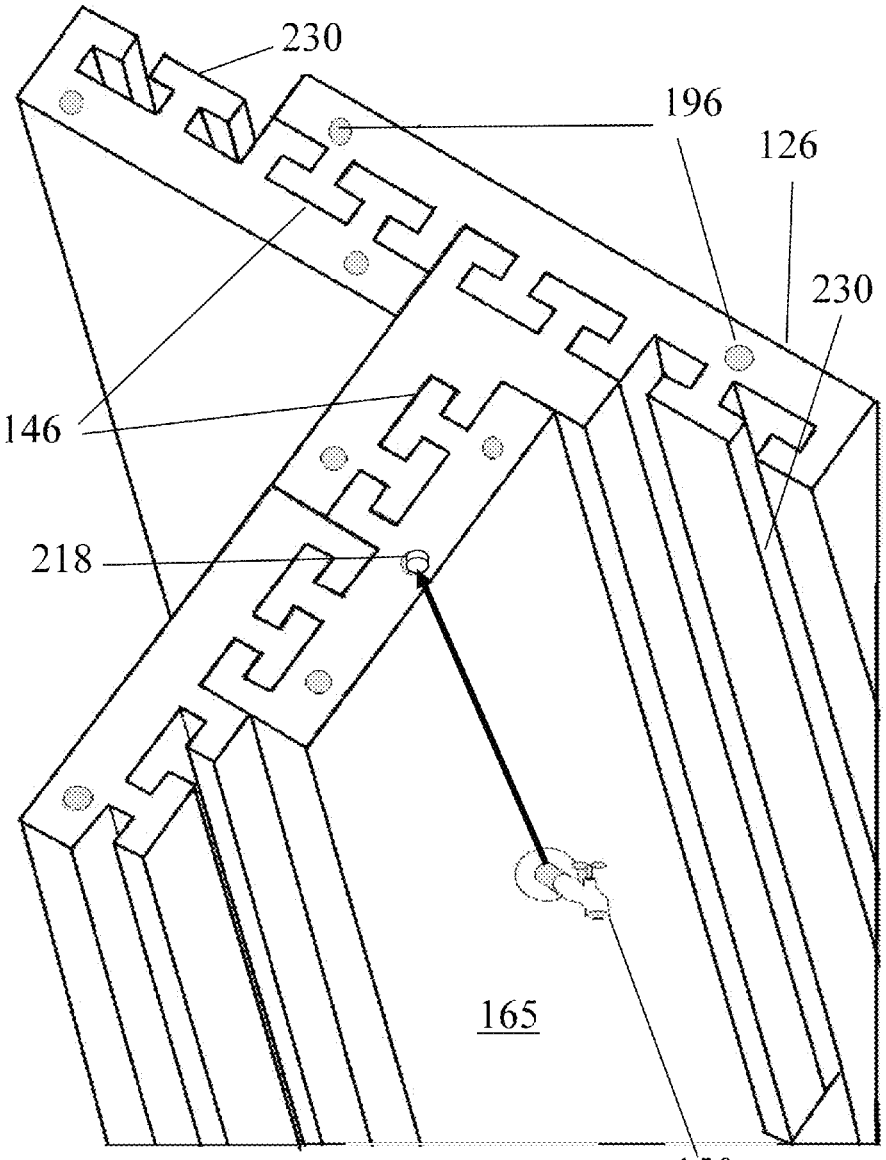
Figure 36A:
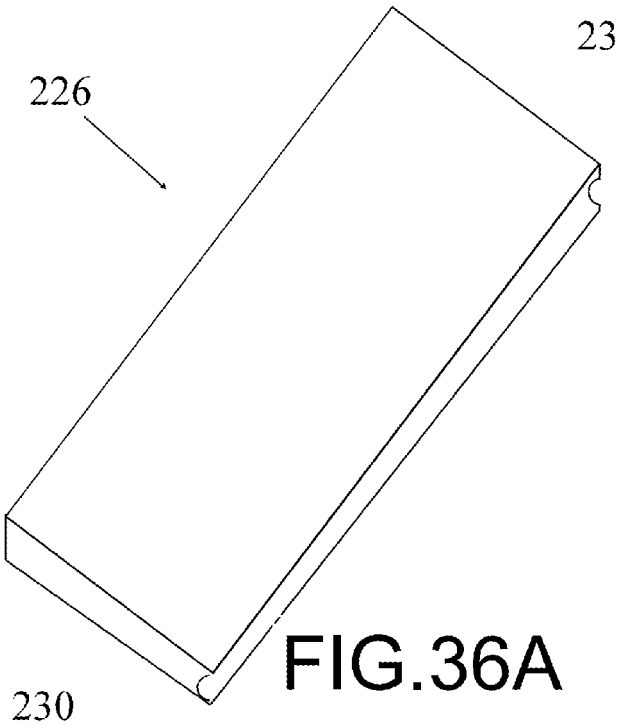
Figure 36B:
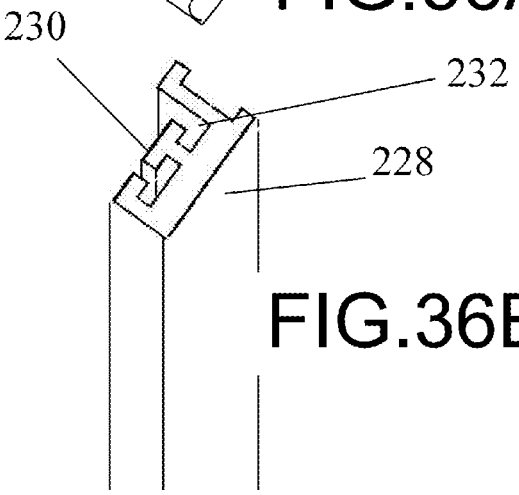
Figure 36C:
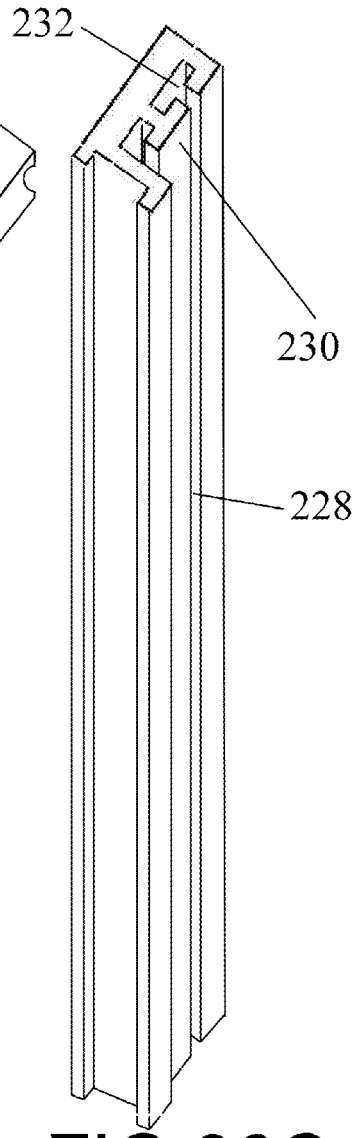
Figures 37A, 37B, 37C:
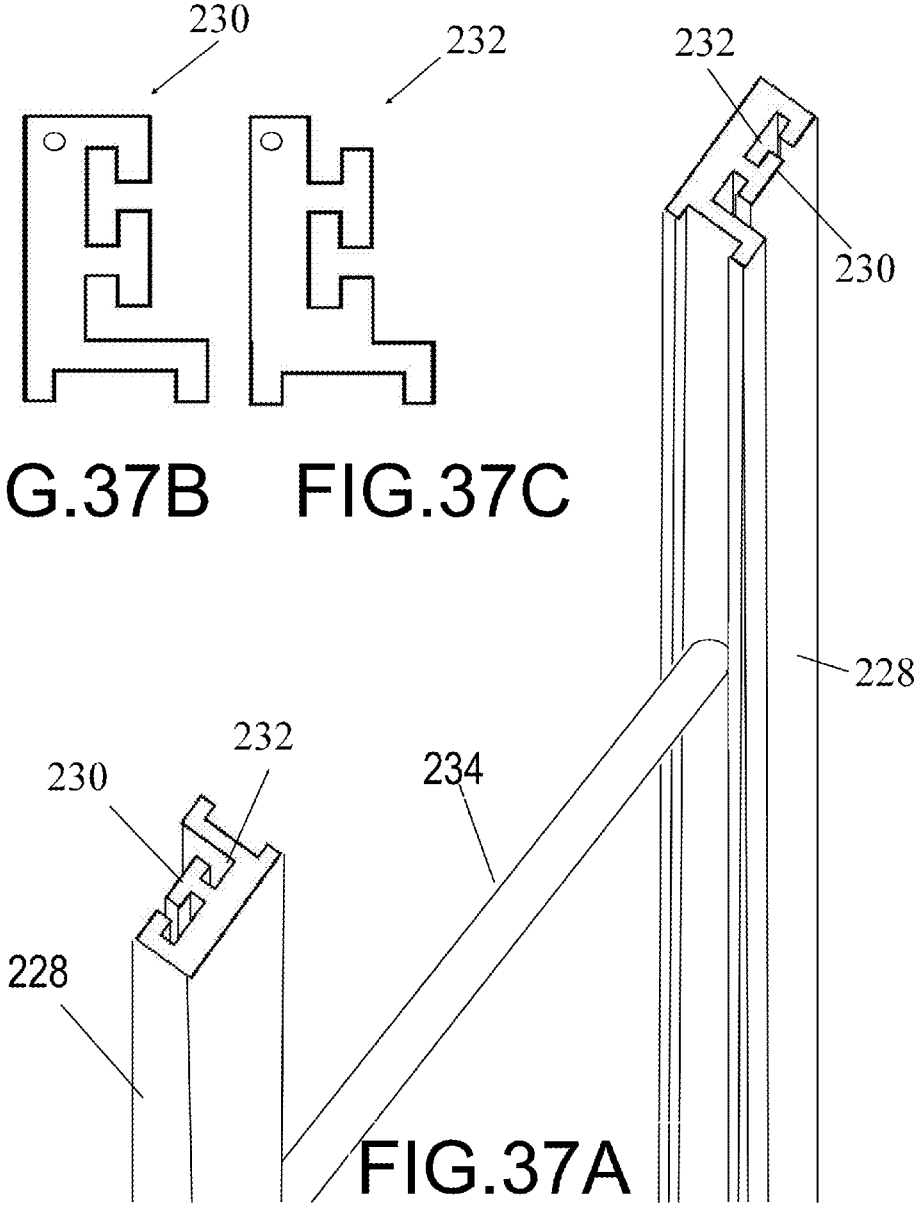
Figure 38:
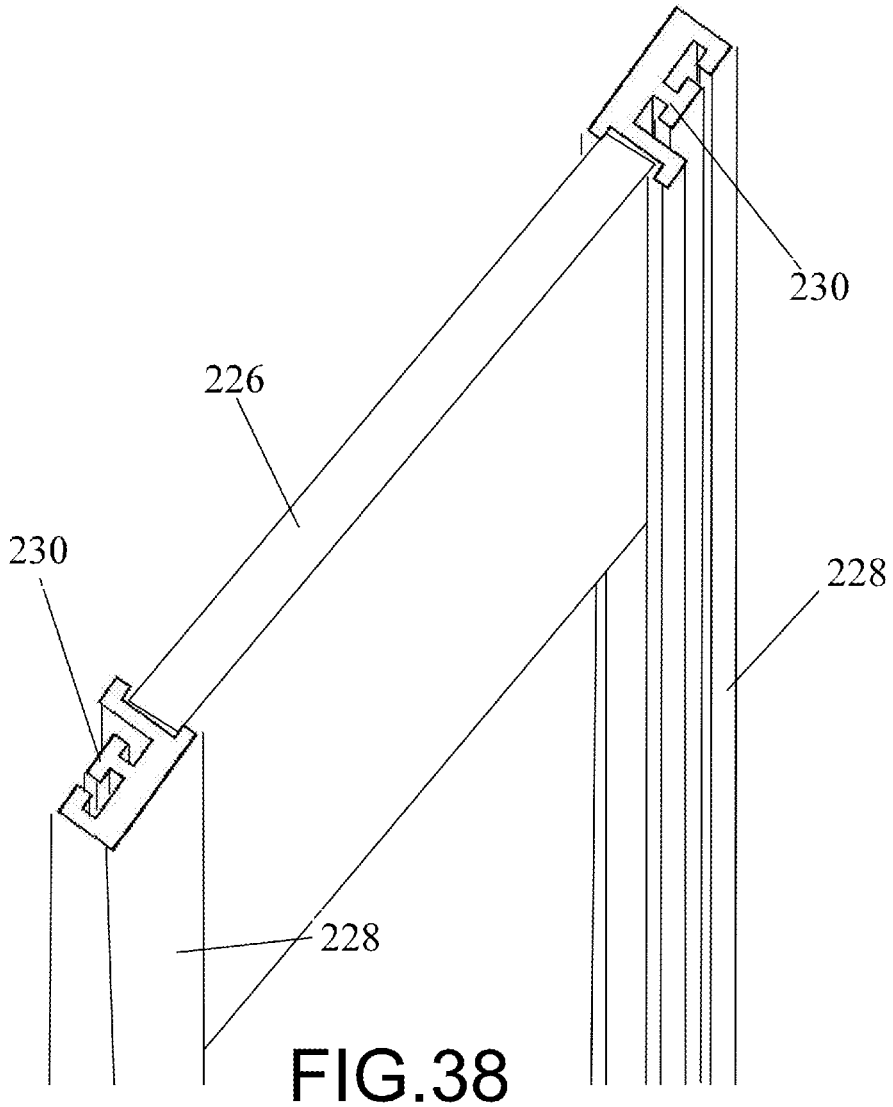

FIGS. 12A, 12B, 12C, and 12D are top views of exemplary panels frictionally interconnected at the panel edges, where FIG. 12A shows the panel edges with an exemplary double spike configuration, where both spikes orient in the same direction, FIG. 12B shows the double spike configuration with both spikes pointed away from each other, FIG. 12C shows the panel edges with an exemplary semi-circle configuration, and FIG. 12D shows an exemplary hole surrounded by panels having a variety of shapes at the panel edges;

FIG. 13 is a top view of an exemplary panels having double-spike panel edge shapes, panel conduits, and a hole to provide plumbing capacity;

FIG. 14 is a top view of four sets of variously sized panels, with each set frictionally interconnected with a double spike shape;

FIG. 15 is a top view of panels frictionally interconnected and forming a substantially U-shape;

FIG. 16 is a top view of panels frictionally interconnected and forming a substantially T-shape that aligns with a linear shape;

FIG. 17 is a top view of three sets of panels frictionally interconnected with double spike shapes and a hole for supporting the panels;

FIGS. 18A and 18B are top views of panels joined around a hole, where FIG. 18A shows the panels forming a square configuration around a central hole, and FIG. 18B shows the hole cut through a corner panel;

FIGS. 19A and 19B are perspective views of exemplary panels, where FIG. 19A is a shim panel frictionally interconnected with a floor panel, and FIG. 19B is a floor panel with a conduit;

FIG. 20 is a perspective view of two shim panels filling a channel block frictional channel of a channel block;

FIGS. 21A and 21B are perspective views of alternatively shaped panels, where FIG. 21 is an exemplary panel for hexagonal configurations, and FIG. 21B is a curved panel;

FIG. 22 is a side view of alternatively shaped panels forming a triangle shape with an exemplary apex panel;

FIG. 23 is a top view of the panels with projections and recessions positioned on the interior and the exterior surfaces of the panel edges;

FIG. 24 is a top view of variously shaped panels with the double spike projection and recession with a center circle;

FIGS. 25A and 25B are panels joining at the panel edges, where FIG. 25A shows a double spike projection and recession with a center circle, and FIG. 25A shows the frictional engagement thereof;

FIGS. 26A and 26B show variously shaped panels with the double spike projection and recession with a center circle, where FIG. 26A the panels are separated, and FIG. 26B the panels are frictionally interconnected;

FIG. 27 is a perspective view of an alternatively shaped shim panel having a shim conduit;

FIGS. 28A and 28B is a top view of panels forming a step configuration, where FIG. 28A illustrates a stairway from joined panels, and FIG. 28B illustrates a stair linker for linking the panels together in the stair configuration;

FIG. 29 is a perspective close-up view of two panels having curved mating surfaces;

FIG. 30 is a perspective close-up view of two panels having curved mating surfaces and an air conditioning conduit passing between;

FIG. 31 is a perspective close-up view of two panels having holes for receiving fasteners, and an air conditioning conduit passing between;

FIGS. 32A, 32B, and 32C are top views of panel edges having a semicircle shaped projections and recessions, where FIG. 32A shows two panels frictionally interconnected, FIG. 32B shows a single panel with the semicircle shape, and FIG. 32C shows an L-shaped panel having a semicircle panel edge;

FIGS. 33A and 33B are top view of the panel edges having four semicircle shaped projections and recessions, where FIG. 33A shows tow panels frictionally interconnected and FIG. 33B shows a single panel with the semicircle shape;

FIG. 34 is a perspective view of an alternatively shaped shim panel having two different shims and a shim conduit;

FIG. 35 is a perspective view of a wall panel and a floor panel frictionally interconnected and having a wall conduit for carrying a water line;

FIGS. 36A, 36B, and 36C are perspective views of various configurations of panels, where FIG. 36A shows a flat panel, FIG. 36B shows a T-projection panel from a left perspective, and FIG. 36C shows a T-projection panel from a right perspective;

FIGS. 37A, 37B, and 37C are close-up and perspective views of various configurations for a T-projection panel, where FIG. 37A is a T-projection, and FIG. 37B is a T-recession, and FIG. 37C is an exemplary rod joining two T-panels;

FIG. 38 is a perspective view of a flat panel joining two T-panels; and

Figure 39:
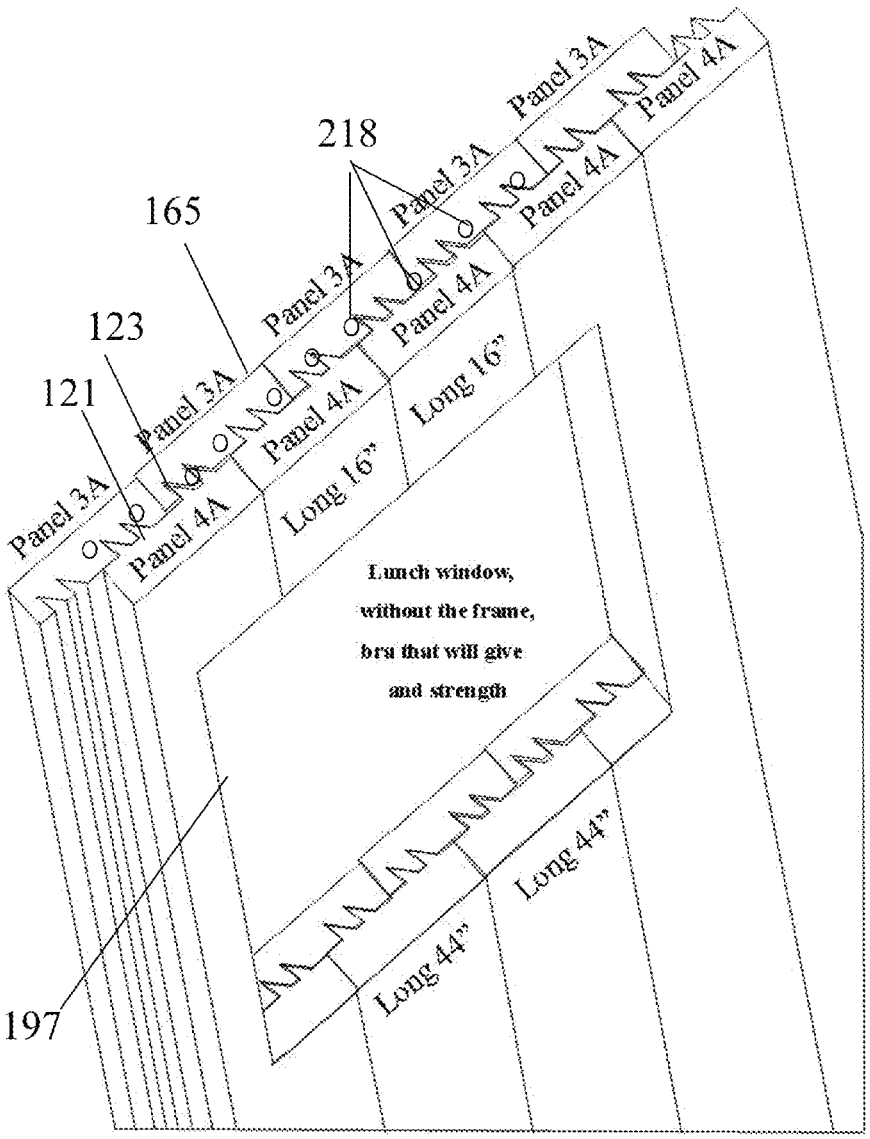

FIG. 39 is a perspective side view of exemplary wall projections having a double-spike shape frictionally engaged with wall recessions having a double-spike shape.

DESCRIPTION

One embodiment of the present invention, referenced in FIGS. 1-39, illustrates a modular construction system 100 for constructing structures from individual modular components. The system 100 provides individual modular components that frictionally interconnect to form rigid, yet flexible structures that maintain structural integrity through lateral frictional snap-lock interconnections without requiring the components to slide against each other, or necessitating the need for special tools to fasten together. In some embodiments, the system 100 utilizes frictional channels 104*a*, 104*b* that create a frictional snap-lock engagement to connect the modular components, and thus form the finished structure. The frictional channel connections use a direct lateral engagement to mate and hold components together. In this manner, an assortment of simple modular components can be interconnected without requiring extra space to slide the individual components against each other to connect.

Figure 1:
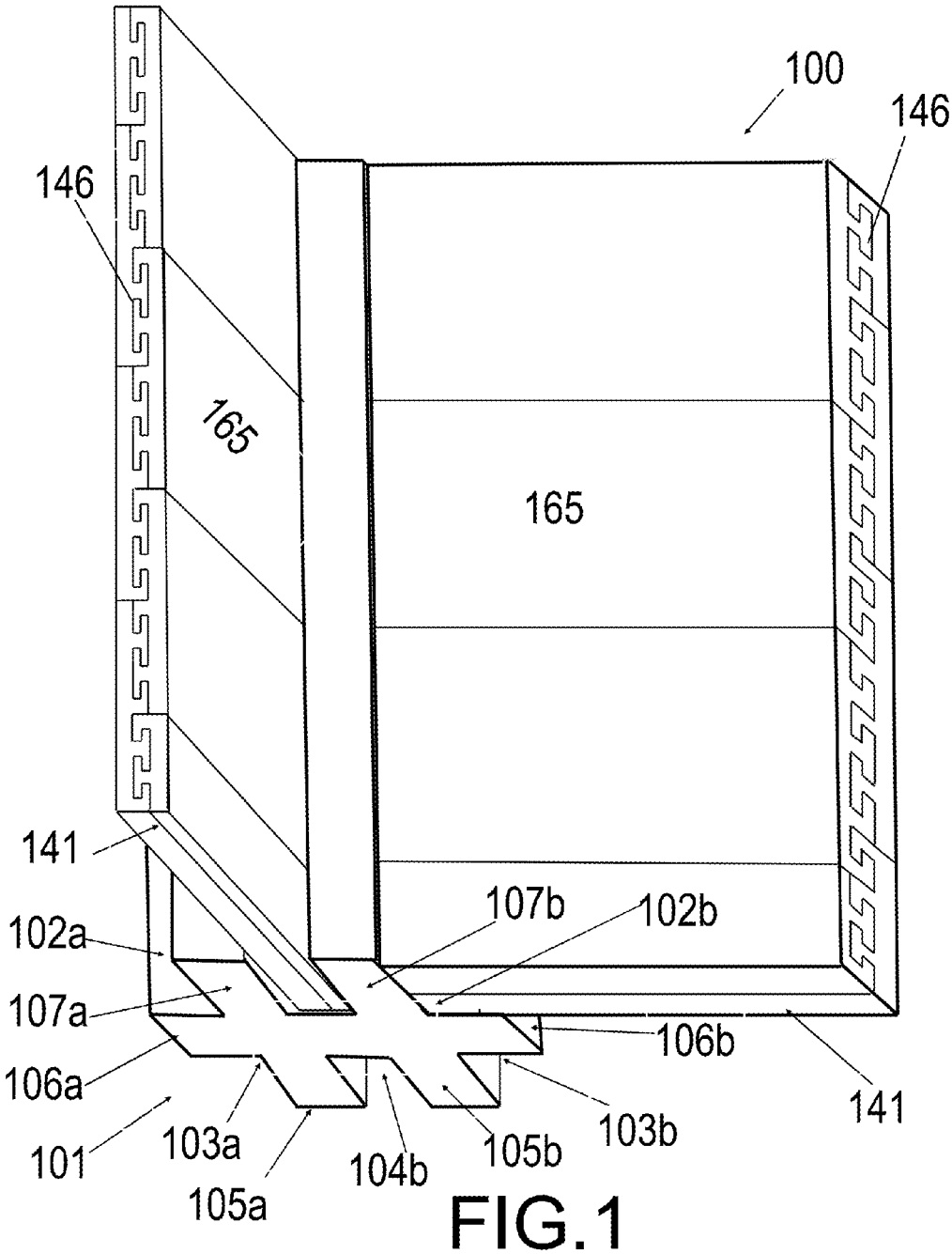
FIG. 1 is a perspective view of an exemplary modular system having an exemplary base supporting an exemplary wall panel.

As referenced in FIG. 1, the system 100 comprises eclectic shapes and dimensions of modular building components, including, without limitation, a wall panel 165, a floor panel 126, a base 101, a divider 109, a roof truss 152, a roof base 164, and at least one hole 180. These components can be configured into numerous structural designs and orientations. The modular components are connected in a particular configuration which permits multiple modular components to be mounted together in horizontal and vertical arrays. Each component may have a frictional channel 104*a* that mates with a corresponding frictional channel 104*b* from another component. The frictional channels 104*a*, 104*b* are pre-cut in the components to allow for efficient mating through the frictional snap-lock engagement, or for connectors to seat in the frictional channels 138, 142 of adjacent components, forming a clean joint between two channeled components.

Suitable materials for the modular components may include, without limitation, single or multi-layers of softwood, hardwood, compressed wood pulp, aluminum, foam, polyethylene (HDPE), polypropylene, polyvinyl chloride (PVC), low density polyethylene (LDPE), CPVC ABS, ethyl-vinyl acetate, other similar polyethylene copolymers, thermoplastic materials, and cellulosic/polymer composites. The components may be prefabricated at a factory and assembled at the construction site.

In some embodiments, the modular system 100 can also utilize a fastener 126, such as screws and bolts, to reinforce the frictional interconnections. Assembly in this fashion provides a friction fit and achieves substantial stability. This stability is present in completed and partially assembled structures, allowing whole projects or sections thereof to be moved during construction with minimal risk of structural collapse. In some embodiments, the component interconnections have sufficient flexibility at their frictional connections, so that the structure dampens vibrations from earthquakes and can withstand external forces, such as strong winds, tidal waves, and explosive reverberations.

Additionally, conduits 196, 218 may extend through the length of the panels 165, 126, base 101, divider 109, roof truss 152, roof base 164, a hole 180 for plumbing fixtures, and conduits 196 to enable passage of wiring 148, water lines 150, gas lines, and other habitual necessities. In some embodiments, the system 100 supports the possibilities of a wide variety of configurations and specialty members, which may be added to effect distinct characteristics, features, and functionality. These may include, without limitation, lighting, roof shingles, stair cases, doors, and windows that incorporate into the finished structure.

Figure 2:
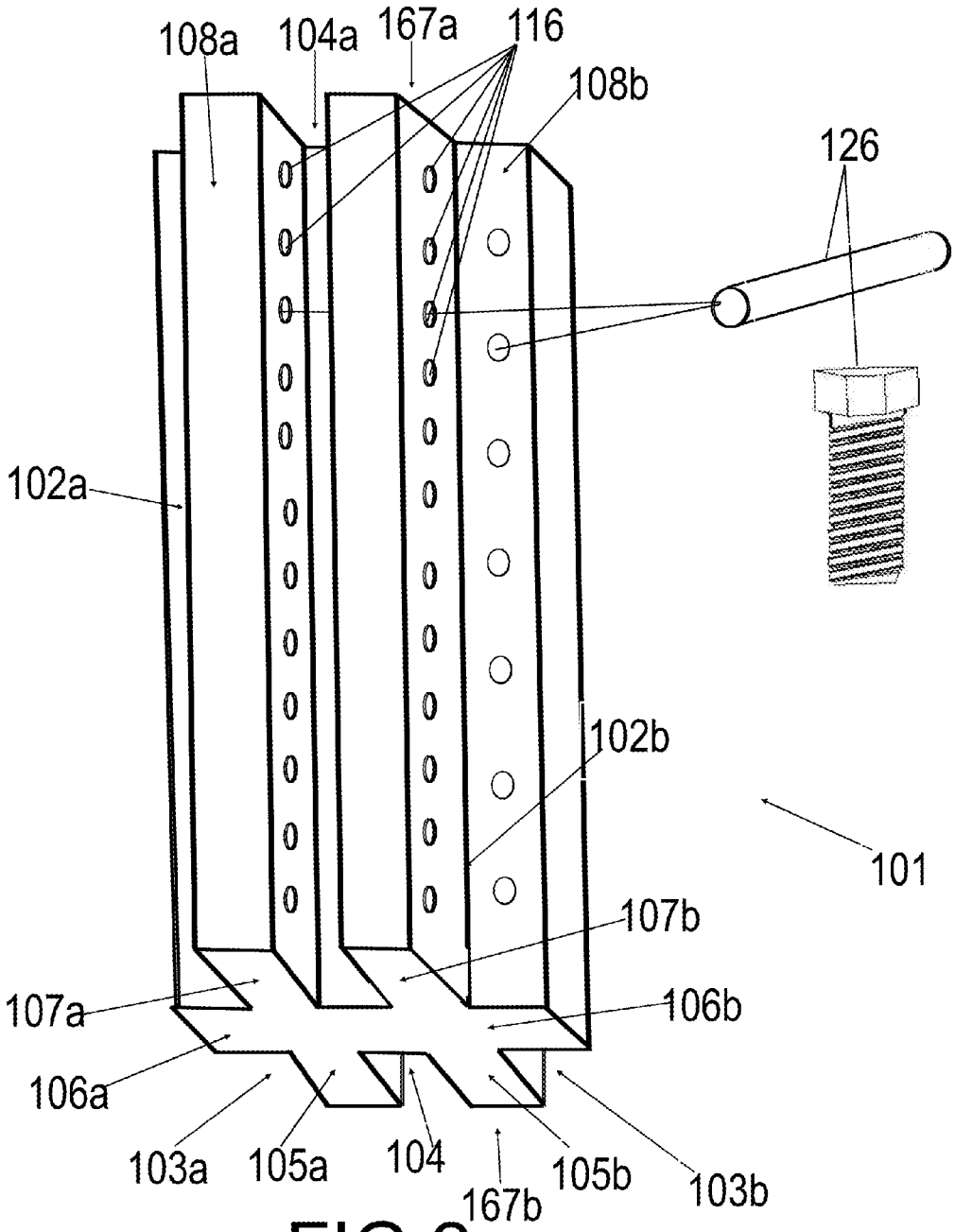
FIG. 2 is a perspective view of a base having a pair of channel sides and a pair of tongue sides.

Turning now to FIG. 2, the system 100 for constructing a flexible, yet sturdy modular structure through frictional mating comprises a base 101 that forms the foundation for the structure and provides a surface for interconnections with the other components. The base 101 is defined by a pair of channel sides 167*a*, 167*b* at each end of the base 101. Along the length of the base 101, forms a pair of base frictional channels 104*a*, 104*b* and a pair of tongue sides 110*a*, 110*b*. The base 101 is generally elongated and has a substantially rectangular cross section. Each channel 104*a*, 104*b* on the base 101 has two base protrusions 105*a*, 105*b*, 107*a*, 107*b* that extend along the length of the base 101. The base protrusions 105*a*, 105*b*, 107*a*, 107*b* provide surface area for support and rigidity.

A plurality of angles 102*a*, 102*b*, 103*a*, 103*b* form between the base protrusions 105*a*, 105*b*, 107*a*, 107*b* and the tongues 110*a*, 110*b*. At least one base frictional channel 104*a*, 104*b* forms between the base protrusions 105*a*, 105*b*, 107*a*, 107*b*. The base frictional channel 104*a* is sized and dimensioned to generate friction when a wall or floor panel 165, 126 is engaged within. In one embodiment, the base frictional channel 104*a* may have a width between ¼" to 2".

The base protrusions 105*a*, 105*b*, 107*a*, 107*b* include a plurality of base apertures 116 that form a transverse axis across the base 101. The base apertures 116 enable passage of the fastener 126 for providing additional structural integrity. The base apertures 116 from each protrusion 105*a*, 105*b* align to enable a straight passage for the fasteners 126. Additionally, each tongue side 110*a*, 110*b* is defined by a tongue 106*a*, 106*b* that extends along the length of the base 101. The tongue 106*a*, 106*b* forms a supportive surface for holding up the panels 165, 126. In one embodiment, the tongue 106*a*, 106*b* forms a substantially 90° with the base 101. In another embodiment, the tongue 106*a*, 106*b* may extend about 6" from the tongue side 110*a*. Though a longer or shorter tongue 106*a*, 106*b* may be used.

The system 100 further comprises a wall panel 165 defined by a plurality of wall panel edges 141. The wall panel 165 is a vertical structural support means, which may be a continuous closed structure covering one-half of the long sides of the other panels 126, 160, or the wall panel 165 may be an open framework which provides access openings, such as a window or door. In some embodiments, the wall panel 165 comprises of half-wall panels joined together at a panel seam 146. The panel seam 146 is formed through a frictional snap-lock engagement. The panel seam 146 creates greater modular functionality by enabling the wall panel 165 to be bifurcated into two separate half-wall panels when a thinner wall panel is required during construction.

In some embodiments, the wall panel edges 141 are arranged to mate with the base frictional channel 104*a* in a frictional snap-lock engagement. At least one of the wall panel edges 141 is defined by at least one wall projection 122 that extends laterally from the wall panel edges 141. An example of the at least one wall projection 122 can be a double-spike shape. Though any shape may be used for the wall projection 122. At least one of the wall panel edges 141 is also defined by at least one wall recession 124 that recesses laterally and forms an identical shape to the wall projection 122. Both the wall projection 122 and wall recession 124 have a frictional periphery to form the frictional snap-lock engagement with each other.

The shape of the wall projection 122 is adapted to fit into the identical shape of the wall recession 124 of an adjacent wall panel 165. Consequently, the wall panels 165 may be interconnected together in by inserting a projections 122 of one wall panel 165 into a wall recession 124 of an adjacent wall panel 165. In addition, a fastening means may be used to further secure the wall panels 165 together. An example of the at least one wall recession 124 can be a recessed double-spike shape that is identically shaped to the double-spike to create a corresponding mating surface. In this manner, the at least one wall projection 122 is arranged to mate with the at least one wall recession 124 of an adjacent wall panel 165 in a frictional snap-lock engagement.

The direct engagement between the wall projection 122 and the wall recession 124 enable adjacent wall panels 165 to interconnect without requiring one wall panel 165 to slide across the edge of another wall panel 165. Rather the panels 165 can mate directly into a frictional snap-lock engagement. This eliminates the need for extra space above and below the panels 165 for sliding together. Additionally, the wall panel 165 is defined by at least one wall conduit 218 used to carry wiring, water pipes, or gas lines. The wall conduit 218 may extend laterally through the wall panel 165.

The system 100 further comprises a floor panel 126 defined by a plurality of floor panel edges 128. The floor panel 126 has the dual purpose of serving as a floor and a ceiling, depending on the relative position to the other components. The floor panel edges 128 are arranged to form the angles 102*a*, 102*b*, 103*a*, 103*b* between the tongue 106*a*, 106*b* and each protrusion 105*a*, 105*b*, 107*a*, 107*b*. In this manner, the floor panel 126 receives a supportive platform from above, or below, depending on the level of the floor panel 126.

At least one of the floor panel edges 128 is defined by at least one floor projection 130 that extends laterally from at least one of the floor panel edges 128. An example of the floor projection 130 can be a semicircle shape. At least one of the floor panel edges 128 is also defined by at least one floor recession 132 that recesses laterally into the floor panel 126. An example of the at least one floor recession 132 can be a recessed semicircle shape that is identically-shaped to a projecting semicircle shape to create a corresponding mating surface. Both the floor projection 130 and floor recession 132 utilize frictional connections along their floor panel edges 128 to form the frictional snap-lock engagement.

Figure 3:
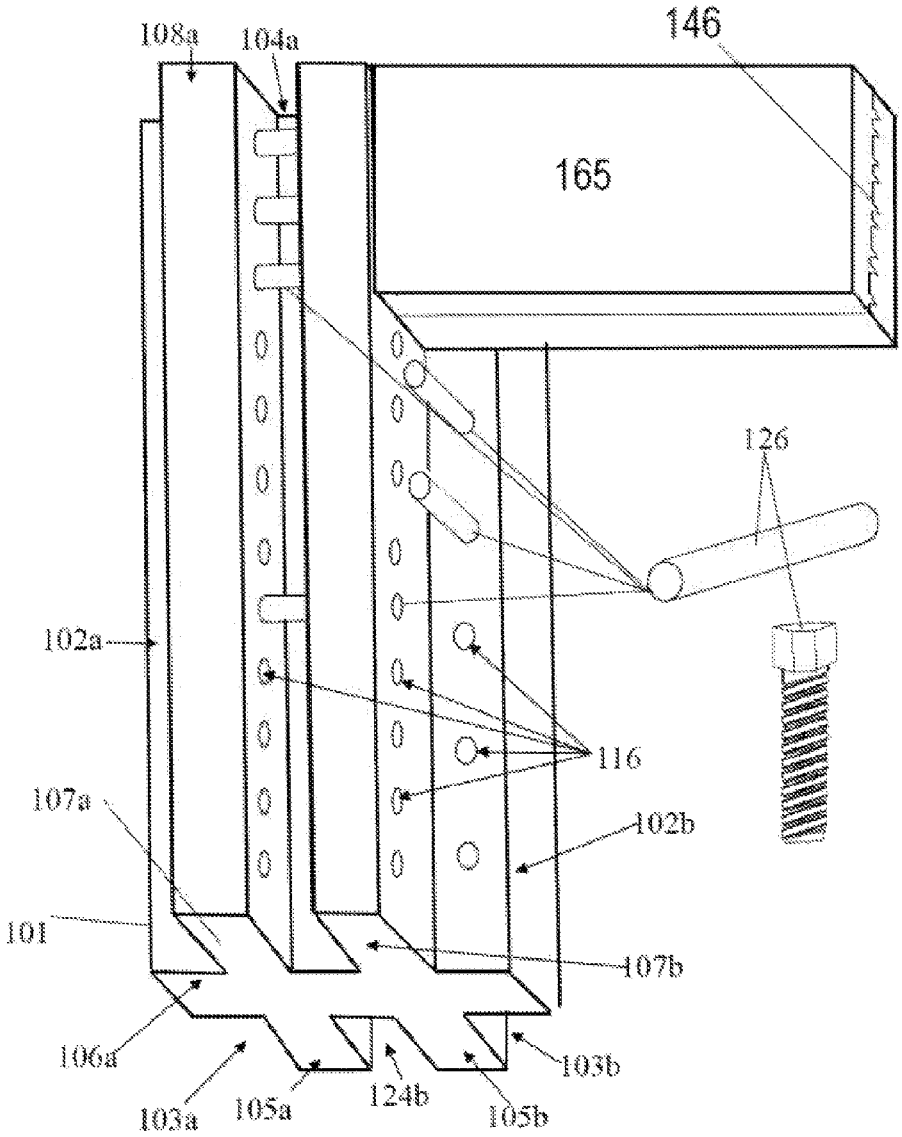
FIG. 3 is a perspective view of a plurality of fasteners passing through a plurality of base apertures.

As illustrated in FIG. 3, the shape of the floor projection 130 is adapted to fit into the identical shape of the floor recession 132 of an adjacent floor panel 126. Consequently, the floor panels 126 may be interconnected together in by inserting a floor projection 130 of one floor panel 126 into a floor recession 132 of an adjacent floor panel 126. In addition, a fastener 126 may be used to further secure the floor panels 126 together along with the frictional snap-lock engagement. Additionally, the floor panel 126 is defined by at least one floor conduit 196 used to carry wiring, water pipes, or gas lines.

In some embodiments, the floor panel 126 is comprised of half-panels joined together at the panel seam 146. The panel seam 146 is formed through a frictional snap-lock engagement and enables the floor panel 126 to be separated in two thinner sections. In one alternative embodiment, the floor panel 126 and the wall panel 165 may be jointly post-stressed so that the assembled panels 165, 126 in the ultimate structure have strengths for supporting live loads which greatly exceed the dead load strength of the individual panels 165, 126 as fabricated.

In some embodiments, the system 100 may include a divider 109 that provides additional support to the floor panels 126 and wall panels 165, and enables multiple layers of floor panels 126 to be stacked. This may be useful for multi-story buildings. The divider 109 chiefly serves to separate upper and lower floors in the structure. In some embodiments, the divider 109 may have a substantially rectangular cross section, and an elongated disposition. Though other shapes and dimensions may be used for the divider 109, depending on the needs and specifications of the structure. In one embodiment, the divider has a divider conduit 144 that carries wiring 148 and a water line 150 through the length of the divider 109. In one embodiment, a truncated dividers 134 can be used throughout a tall vertical structure to support multiple floor panels 126 and wall panels 165. The truncated divider 134 may have either side truncated to provide additional support to a wall panel 165.

Returning now to the discussion of the floor panel 126 and the wall panel 165, the floor projections and depressions 130, 132; and the wall projections and depressions 122, 124 form frictional snap-lock engagements with each other. The example shown, shows a double-spike wall projection that is adapted to fit into the identical double-spike shape wall recession of an adjacent wall panel 165. The illustration further shows a cut-out from the wall panel 165, which may be used to incorporate a window or door.

Figure 4A:
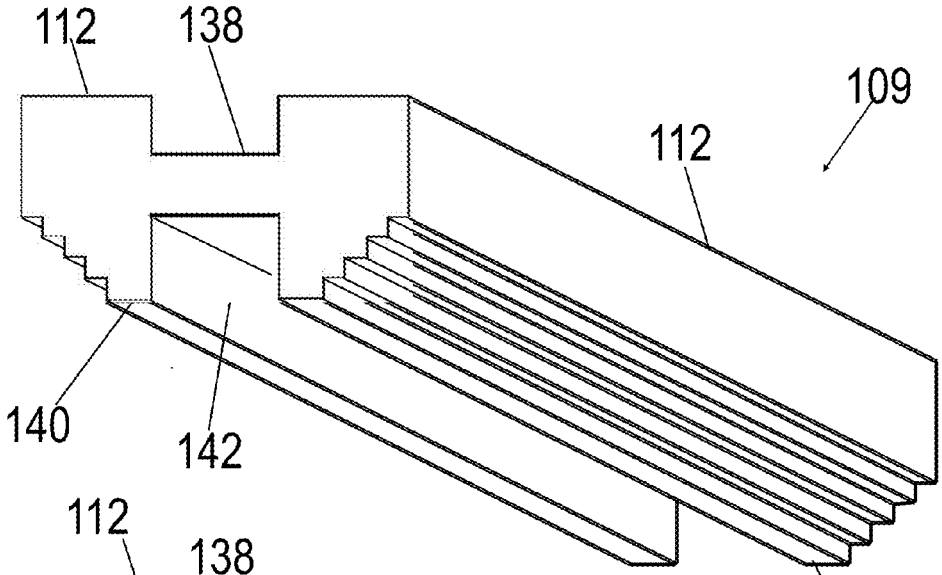
FIGS. 4A and 4B are perspective views of a divider with truncated sides, where
Figure 4B:
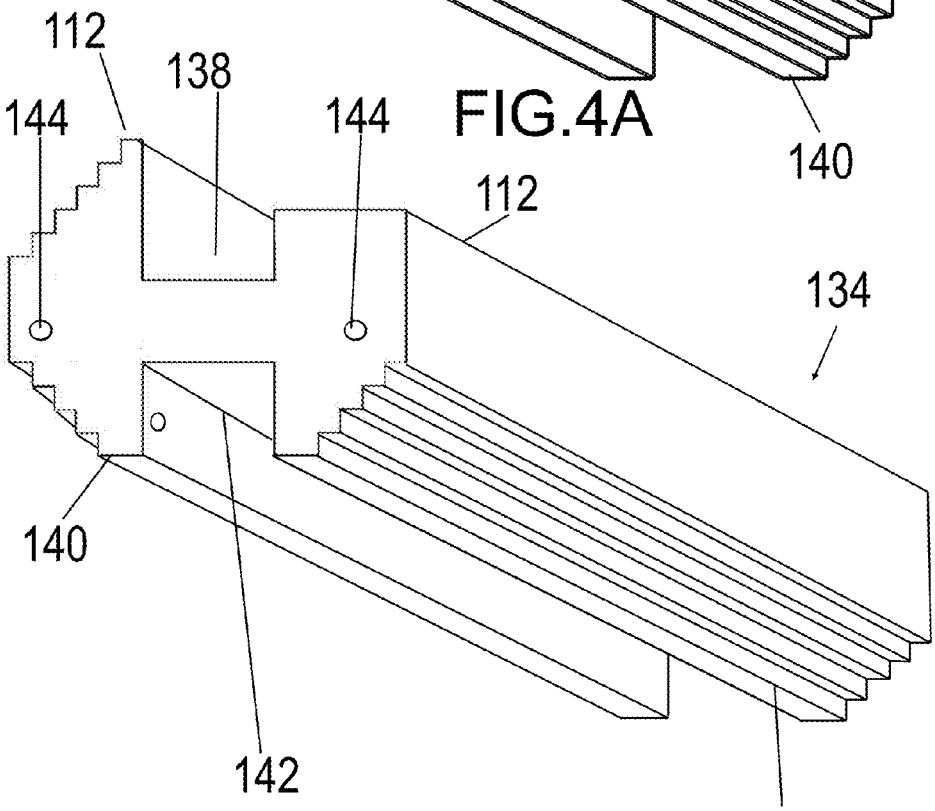

FIGS. 4A and 4B illustrate how one of the divider second sides 140 are truncated. This unsymmetrical configuration of the divider second side 140 may be necessary for fitting the divider 109 in a tight corner, leaving space for additional wall or floor panels 126, or simply for decorative effects, since the stepped shape can be altered to taste. In FIG. 4A, both of the divider first sides 136 are truncated, while in FIG. 4B, a right-hand divider side first side 112 is truncated.

Figure 5A:
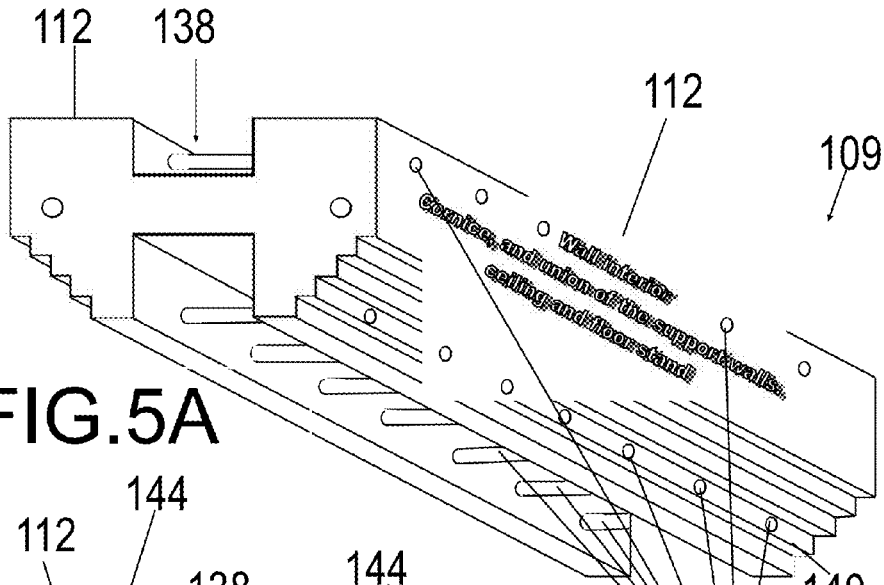
FIGS. 5A and 5B are perspective views of a fastener passing through a divider with truncated sides, where
Figure 5B:
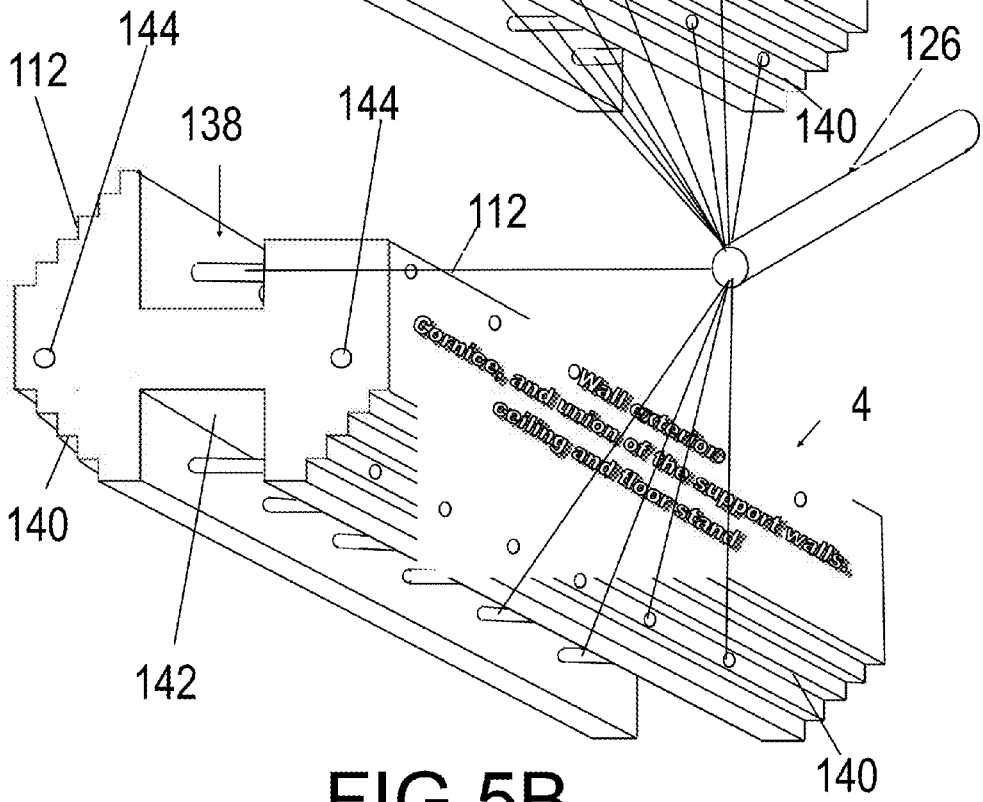

FIGS. 5A and 5B are perspective views of a fastener passing through a divider with truncated sides, where FIG. 5A is shows both first sides truncated, and FIG. 5B shows the right side truncated. The uneven sides may be useful for building around corners or shims.

Figure 6:
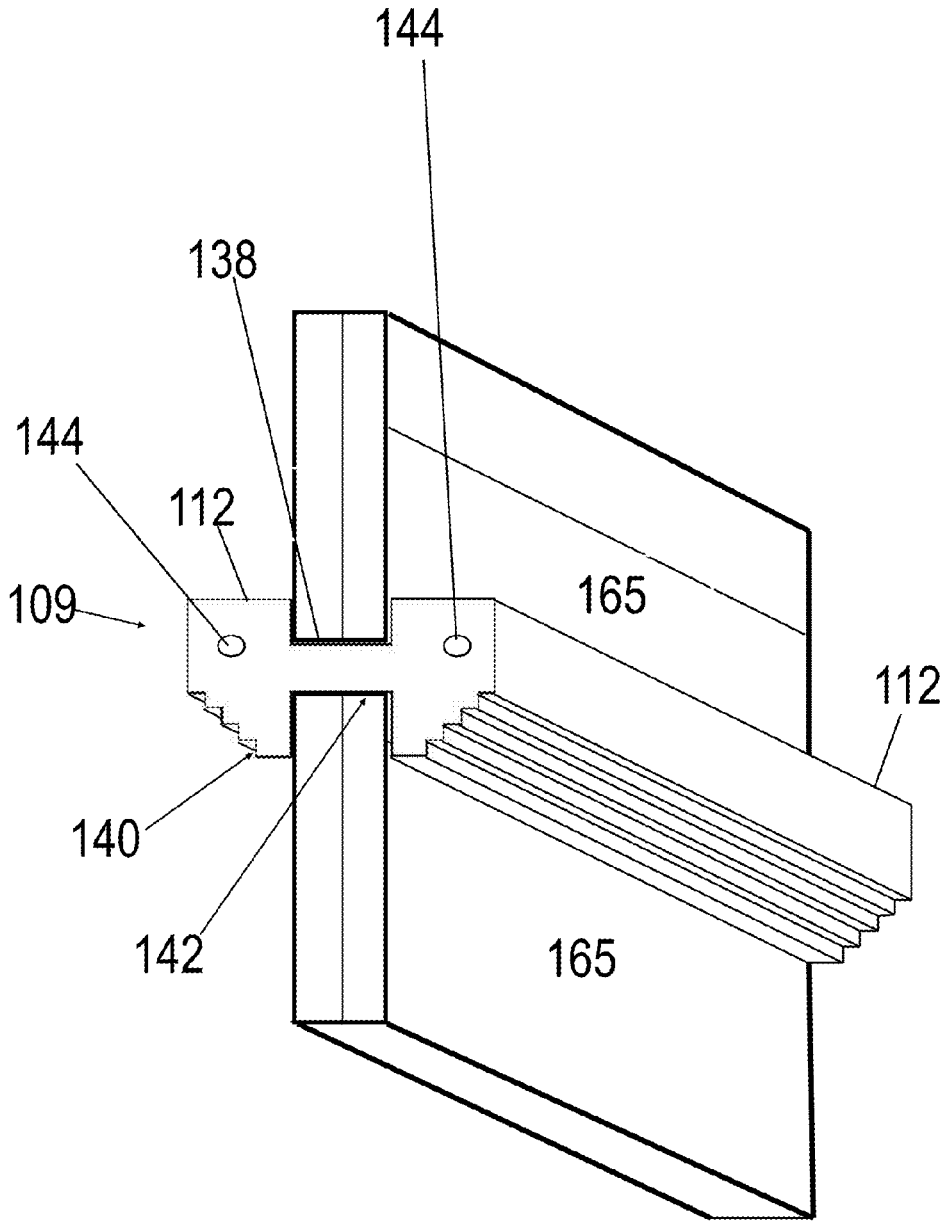
FIG. 6 is a perspective view of an exemplary divider having an even first and second side and engaged with a wall panel.

FIG. 6 illustrates the first frictional channel 138 and the second frictional channel 142 of the divider 109 arranged to mate with the wall panel edges 141 in a frictional snap-lock engagement. In this manner, a wall panel 165 mates with the first frictional channel 138 from above the divider 109, and another wall panel 165 mates with the second frictional channel 142 from beneath the divider 109. Thus, based on the orientation of the floor panel 126 to the divider first and second side 112, 140, and the wall panel's 165 mating engagement with the first and second frictional channels 138, 142, the wall panel 165 and the floor panel 126 meet in a substantially perpendicular orientation at the divider 109.

Figure 7:
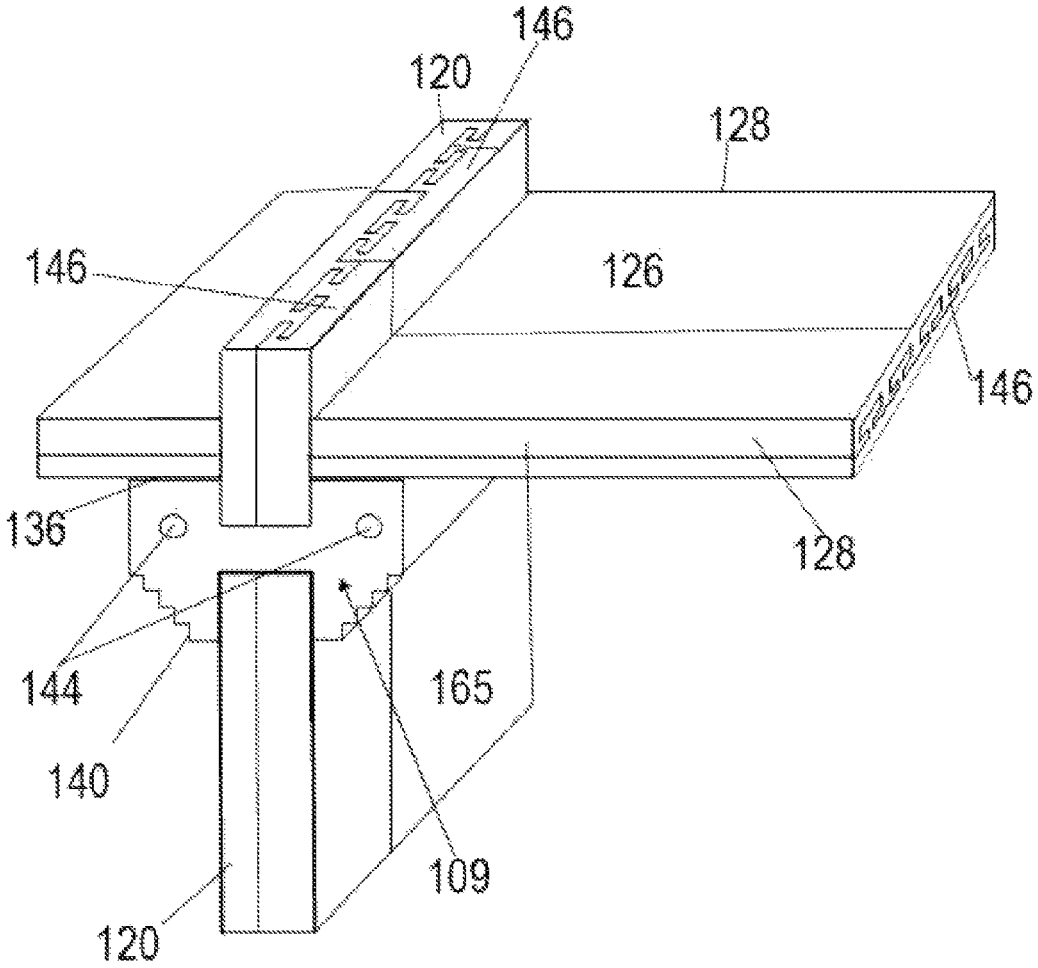
FIG. 7 is a perspective view of an exemplary divider frictionally engaged with a floor panel and a wall panel.

As referenced in FIG. 7, the divider 109 may be defined by a divider first side 112 having a first frictional channel 138 and a divider second side 140 having a second frictional channel 142. The divider first side 112 and the divider second side 140 are arranged to support the floor panels 126 and the wall panels 165. In this manner, a floor panel 126 can rest on the divider first side 112, above the divider 109. In some embodiments, the divider second side 140 may include decorative shapes, such as a stepped configuration. The divider second side 140 engages an additional floor panel 126, often below the divider 109. Thus, by engaging the divider first side 112 and the divider second side 140 with floor panels 165, 126, a first floor and second floor to the structure can be formed.

Figure 8:
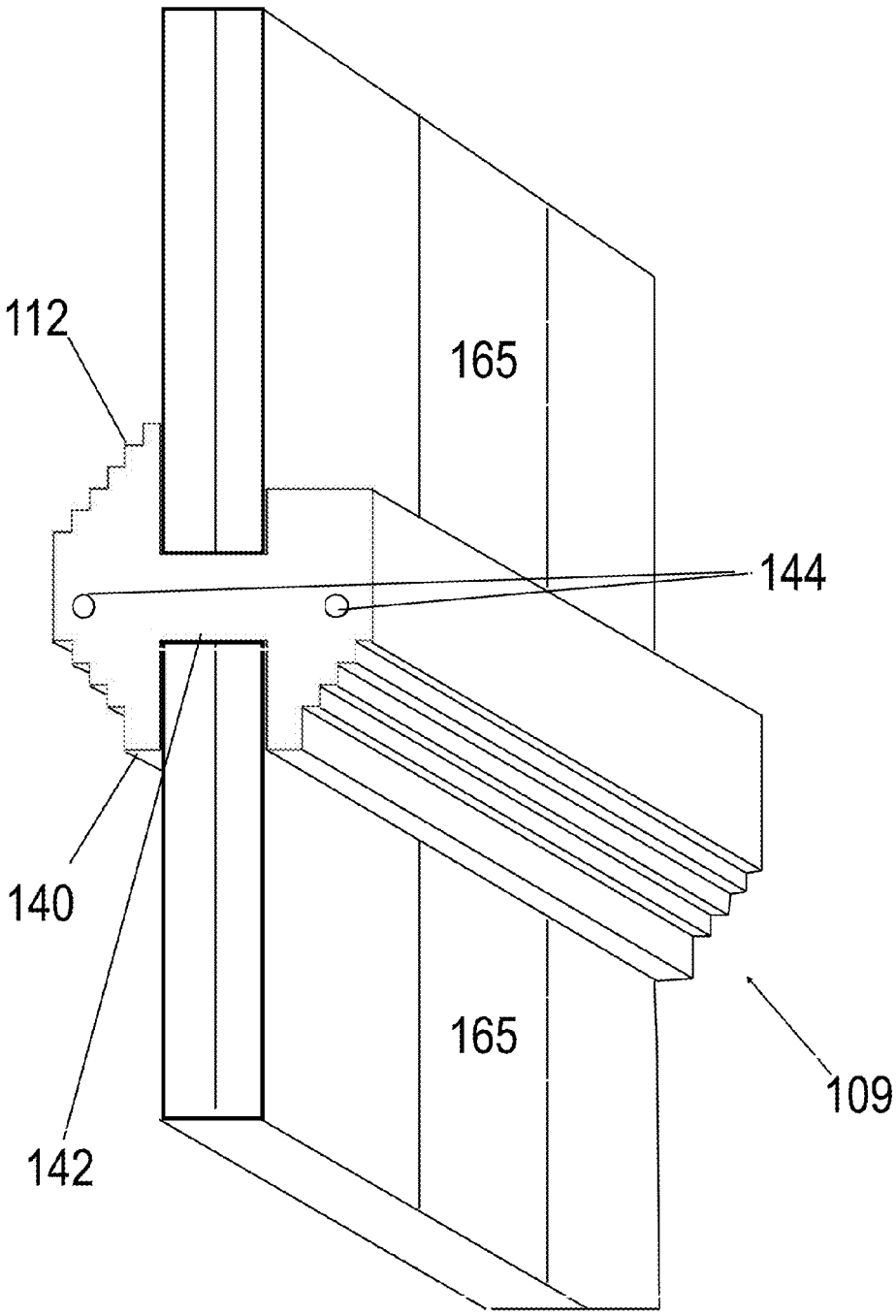
FIG. 8 is a perspective view of an exemplary divider having a truncated first side and engaged with a wall panel.

FIG. 8 is a perspective view of an exemplary divider having a truncated first side and engaged with a wall panel. This truncated configuration enables the wall panel 165 to mate with the first frictional channel 138 from above the divider 109, while another wall panel 165 mates with the second frictional channel 142 from beneath the divider 109. Thus, based on the orientation of the floor panel 126 to the divider first and second side 112, 140, and the wall panel's 165 mating engagement with the first and second frictional channels 138, 142, the wall panel 165 and the floor panel 126 meet in a substantially perpendicular orientation at the divider 109.

Figure 9:
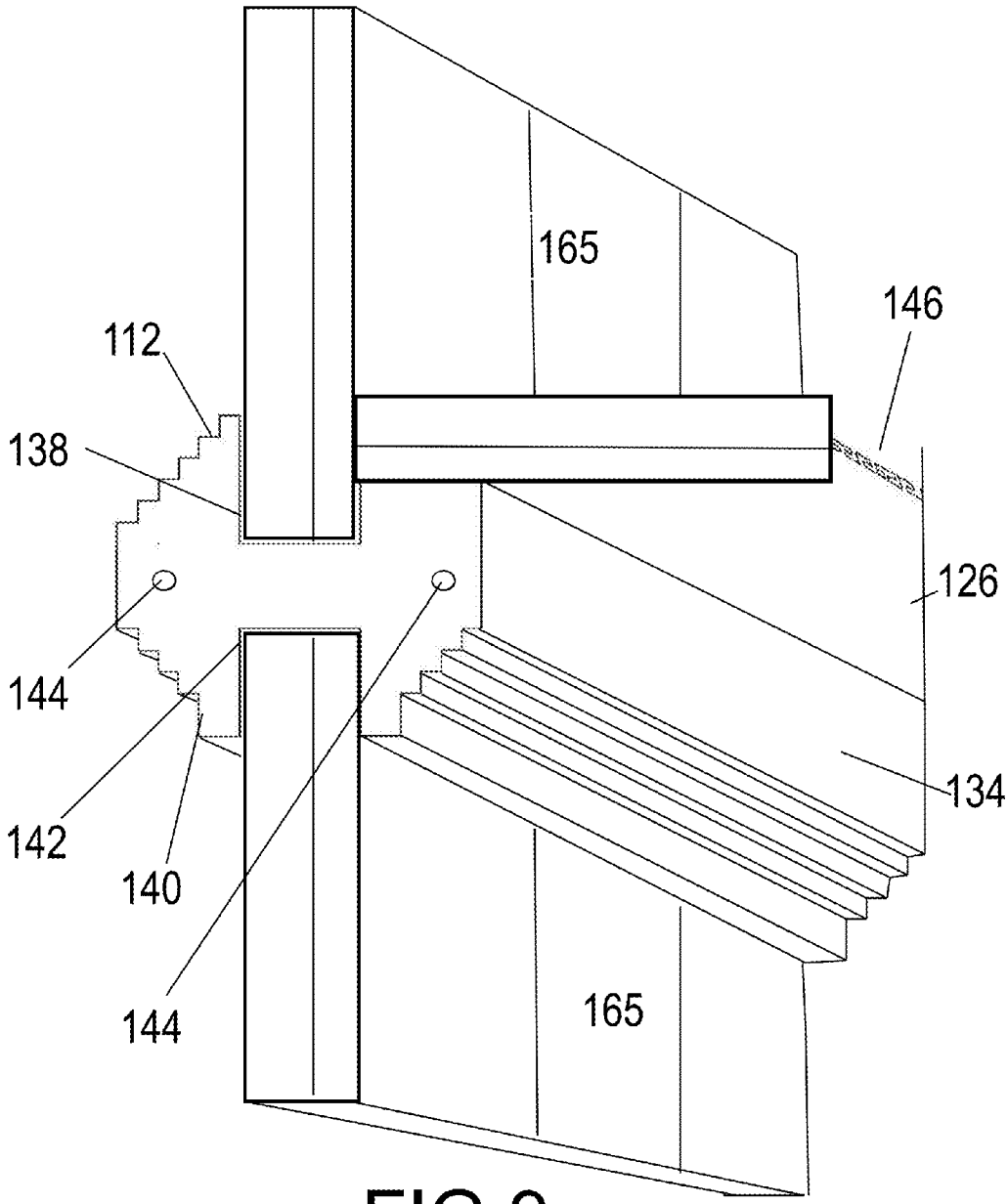
FIG. 9 is a perspective view of an exemplary divider having a truncated first side and engaged with a floor panel.

FIG. 9 illustrates how the truncated right-hand side divider first side 112 forms a flat surface for supporting a floor panel 126, and the left-hand side divider first side 112 is not truncated and abuts against another wall panel 126.

Figure 10A:
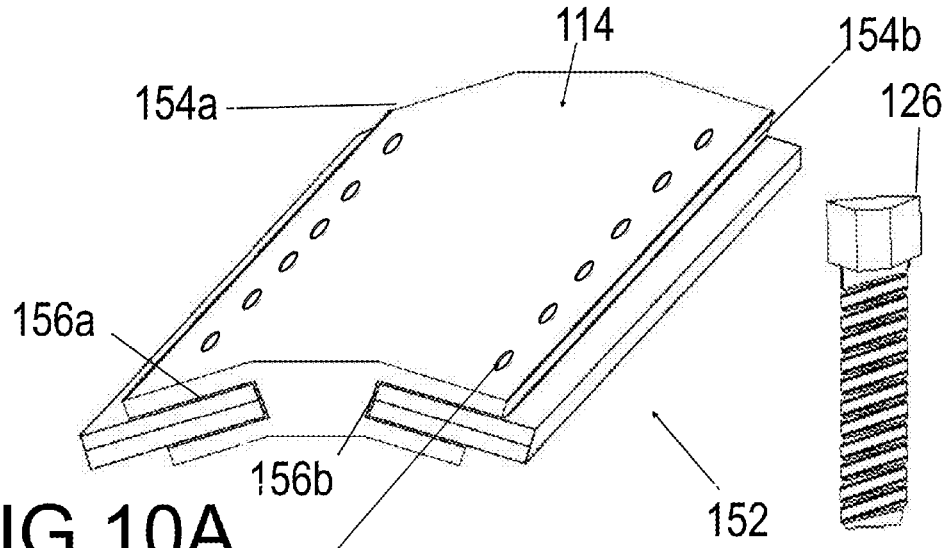
FIGS. 10A and 10B are perspective views of an exemplary roof truss and an exemplary roof base, where

FIG. 10A illustrates a generally arc shaped roof truss 152 that forms a geometric structural support at a roof region of the structure. The roof truss 152 generally includes two-force members, where the members are organized so that the assemblage as a whole behaves as a single supportive component. Those skilled in the art will recognize that external forces and reactions to those forces from the weight of the structure are considered to act only at the nodes of the roof truss 152. This results in forces in the members which are either tensile or compressive forces on the arc shaped region of the roof truss 152. In one embodiment, the roof truss 152 is defined by a generally arc shape; though a triangular shape may also be possible. The generally arced shape of the roof truss 152 not only provides efficient structural integrity, but also helps carry off debris, such as rain and snow from the apex of the structure.

The roof truss 152 is further defined by a pair of lateral ends 154*a*, 154*b*. Each lateral end 154*a*, 154*b* has a roof frictional channel 156*a*, 156*b* that is sized and dimensioned to create the frictional snap-lock engagement with other components, such as the wall and floor panels 165, 126. The roof truss 152 also has a plurality of roof apertures 158 extending along the periphery of the pair of lateral ends 154*a*, 154*b*. The roof apertures 158 enable passage of the fasteners 126 for securing panels 165, 126 to the roof truss 152.

Figure 10B:
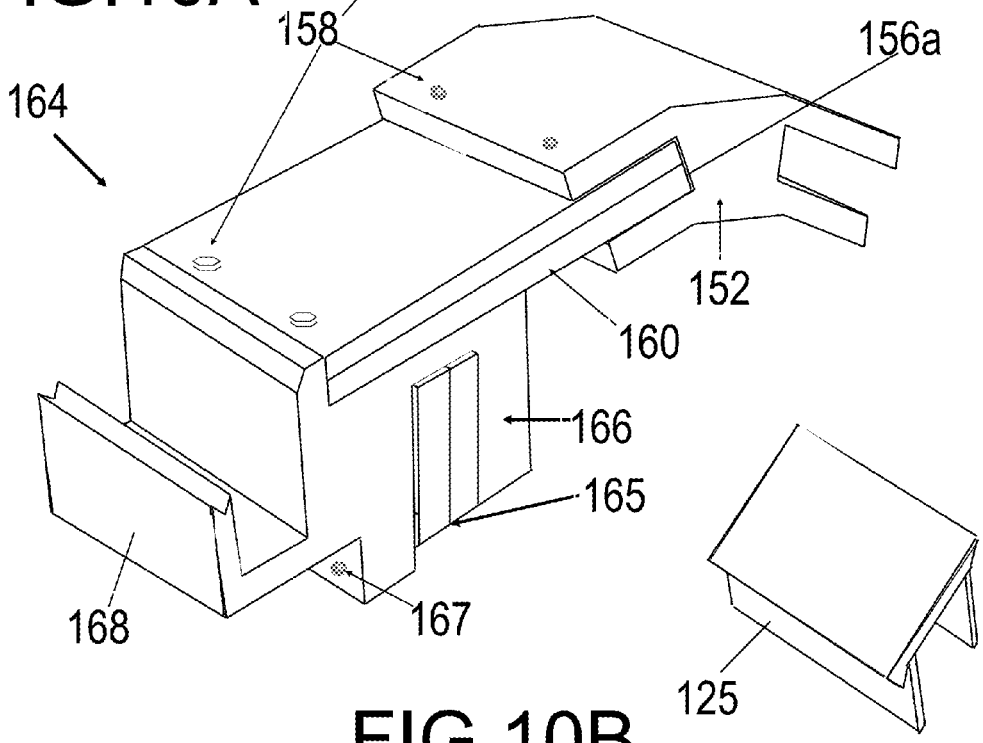

Turning now to FIG. 10B, the system 100 further comprises a roof panel 160 arranged to mate with the roof frictional channel 156*a* in a frictional snap-lock engagement. The roof panel 160 is defined by at least one roof projection 216 and at least one roof recessions 219 which can themselves mate with additional panels 165, 126. FIG. 10B illustrates the roof panel 160 frictionally attached to the roof frictional channel 156*a* from one edge, and resting on a roof base 164 from an opposite edge. The roof base 164 is defined by a generally rectangular block 166 that provides further structural integrity to the roof region of the structure. A block aperture 167 helps secure additional panels 165, 126 to the block 166 through fasteners 126. A block brace 165 strengthens the roof base 164.

In one embodiment, the roof base 164 is the upper-most component in the structure. A roof base frictional channel 168 rests adjacently to the roof base 642. In one embodiment, the roof base frictional channel 168 orients upwardly, towards the roof truss 152 and away from the base 101. However, in other embodiments, the roof base 164, and thus the roof base frictional channel 168 may be oriented downwards or sideways. From any of these orientations, the roof base frictional channel 168 can frictionally mate with the roof panel 160 or the wall panel 165, depending on the design of the structure. A roof base frictional channel cover 125 mates with the roof base frictional channel 168 to prevent snow or debris from filling the roof base frictional channel 168.

In some embodiments, a snow roof truss may be configured for carrying snow from the roof panels 160. The slope of the arc on the snow roof truss may be more defined so as to enable the snow to fall off the roof panels 160. Additionally, the roof apertures 158 are not used with the snow roof truss, so as not to provide a cavity for water or snow to accumulate in. Those skilled in the art will recognize the weight of snow can stress the structure. The snow roof truss, thus helps eliminate this problem through the slope of the arc and the negation of roof apertures 158.

In another embodiment, a block roof panel (not shown) forms a second embodiment of the roof panel 160. The block roof panel engages the roof base 101 to form a junction which can further interconnect with additional roof panels 160. The block roof panel comprises a wedge that slopes down and forms a peripheral region of the roof panels 160. A panel block (not shown) sits adjacent to the wedge. The panel block includes a block panel channel that is adapted to from a frictional snap-lock engagement with the panel block from the roof base 101. A plurality of block roof apertures (not shown) enable passage of fasteners 126 for securing the block roof panel to the roof region.

Figure 11:
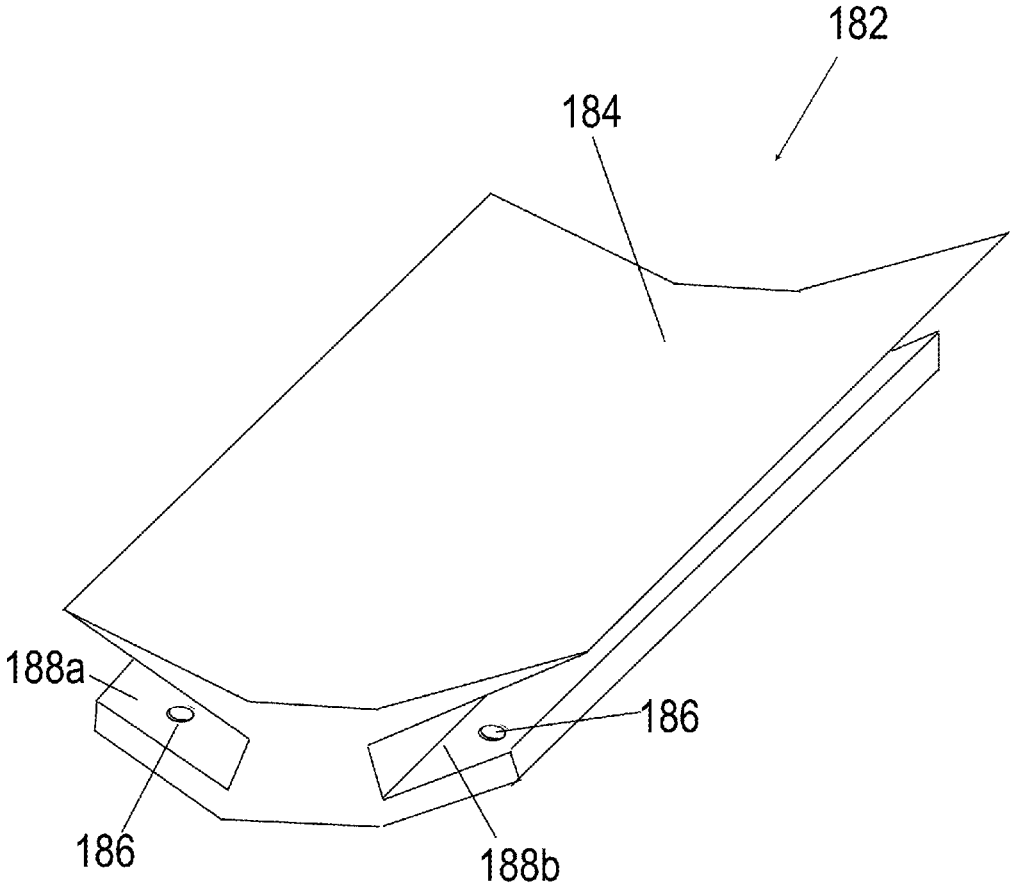
FIG. 11 is a perspective view of an exemplary inverted roof truss.

FIG. 11 is a perspective view of an exemplary inverted roof truss 182 used to carry away moisture and debris from the roof region. The inverted roof truss 182 is defined by a shallow trough 184 that extends along the length of the inverted roof truss 182. The trough 184 can serve as a ridge drain for carrying away water, snow, and other debris from the roof region. A plurality of inverted roof truss apertures 186 enable the fasteners 126 to pass through for fastening to the roof base 164, the block roof panel, or the roof panels 160. A pair of inverted roof truss frictional channels 188*a*, 188*b* enable frictional snap-lock engagement with other roof panels 160.

As referenced in FIGS. 12A, 12B, and 12C, the panels 165 are joined by the frictional mating between projections 122 and recessions 124. The projections 122 and recessions 124 can take a variety of shapes. FIG. 12A shows the panel edges 141 with an exemplary double spike configuration, where both spikes orient in the same direction, FIG. 12B shows the double spike configuration with both spikes pointed away from each other, FIG. 12C shows the panel edges 141 with an exemplary semi-circle configuration. The different shapes are designed to create tension points along the projection 122 and recession 124 that further enhances the frictional interconnections between panels 165. In other embodiments, any shape that is effective for securely interconnecting the panels 165 may be used.

Turning now to FIG. 12D, the modular system 100 may further include at least one hole 180 that extends from a ground surface upwards. The at least one hole 180 can provides a plumbing capacity to the system 100. For example, a toilet or sink can rest on the hole 180 to drain excess water. The hole 180 can pass through the floor panels 126, wall panels 165, and roof panels 160 may be attached. In one embodiment, the hole 180 is defined by a generally circular shape having a diameter and composition sufficiently stout to enable passage of water from a toilet, sink, or shower.

FIG. 13 is a top view of exemplary panels 165, 126 having double-spike panel edge shapes, panel conduits 196, 218, and a hole 180. Similar to the base conduit (not shown), the wall and floor panel conduits 196, 218 carry wiring, water lines, and gas lines. The conduits 196, 218 may pass through the panels 165, 126 laterally or transversely across the panels 165, 126, as may be desired. A pole 199 may help support the panels 165, 126.

In some embodiments, any number of panels 165, 126 may be frictionally interconnected in a variety of shapes and orientations. FIG. 14 shows a top view of four sets of variously sized panels 165, 126, with each set frictionally interconnected with a double spike shape. FIG. 15 shows a top view of panels 165, 126 frictionally interconnected and forming a substantially U-shape. FIG. 16 shows a top view of panels 165, 126 frictionally interconnected and forming a substantially T-shape that aligns with a linear shape.

In some embodiments, the hole 180 forms the center-piece for the structure. Examples of this can be seen in FIG. 17, which illustrates three sets of panels 165, 126 frictionally interconnected with double spike shapes and a hole 180 for supporting the panels 165, 126. Additionally, FIGS. 18A and 18B are depictions of the panels 165, 126 joined around the hole 180, where FIG. 18A shows the panels 165, 126 forming a square configuration around the hole 180 in a central location. However, FIG. 18B shows the hole 180 on a corner panel 202. The corner panel 202 is defined by at least one corner panel projection 204 that frictionally engages the floor recession 132 in a frictional snap-lock engagement.

FIG. 19A is a perspective view of an exemplary shim panel 190 frictionally interconnected with a floor panel 126. A shim panel projection 200 frictionally engages the floor recession 132 to create a frictional snap-lock engagement. The shim panel 190 provides extra depth to the floor panel 126. The shim panel 190 is defined by a shim end 192 having a perpendicularly oriented shim 194. The shim 194 may include a thin, often tapered piece of material used to fill in space between frictional channels and gaps between the wall and floor panels 165, 126. At least one shim conduit 198 enables passage of wiring and water lines. FIG. 19B shows a close-up view of the shim panel 194 including a shim recession 193 that receives a roof projection 216 to form a frictional interconnection in some embodiments. An air conditioning conduit 195 may pass through the length of the shim panel 190.

FIG. 20 is a perspective view of two shim panels 190 filling a channel block 206. The channel block 206 is yet another component offering structural support to the modular system 100. In this example, the shim panels 190 fill a channel block frictional channel 208 of the channel block 206. When desired, the shim panel 190 can be removed and replaced by a wall panel 165, a floor panel 126, or a roof panel 160, as the structure dictates. A plurality of channel block apertures 210 enable fasteners 126 to pass through for securing the shim panels 190 within the channel block frictional channel 208.

FIGS. 21A and 21B show alternatively shaped panels. The various shapes and orientations of the alternatively shaped panels allow for more possible configurations for the structure. FIG. 21A is an exemplary hexagonal panel 210 configured to form hexagonal configurations with other panels 126, 165. That is, when joined with wall, floor, or roof panels 165, 126, 160 the hexagonal panel 210 enables the formation of hexagonal structures and rooms. In one embodiment, a hexagonal panel projection 225 frictionally engages the floor recession 132 to create a frictional snap-lock engagement, and a hexagonal panel recession 227 frictionally engages the floor projection 130 to create a frictional snap-lock engagement. FIG. 21B is a curved panel 212 that enables a curved formation in the structure. A curved panel projection 221 frictionally engages the floor recession 132 to create a frictional snap-lock engagement, while a curved panel recession 223 frictionally engages the floor projection 130 to create a frictional snap-lock engagement.

FIG. 22 is a side view of an apex panel 214 configured to form a triangle shape. In some embodiments, the apex panel 214 may be used on the roof region, similarly to the roof truss 152. In this example, two roof panels 160 frictionally interconnect with the apex panel 214 to create an angled surface along the roof and apex panels 160, 214.

Turning now to FIG. 23, the roof panels 126 are defined by double spike projections 121 and double spike recessions 123 positioned on the interior and the exterior surfaces of the floor panel edges 128. The interior and exterior locations of double spike projections 121 and double spike recessions 123 further increase the possible configurations for the finished structure. In this example, a double spike shape is used; though any shape that is conducive for frictional snap-lock mating may be used.

FIG. 24 is a top view of variously shaped wall and floor panels 165, 126 with the double spike projection 121 and double spike recession 123 with a center hole 180. Similarly, FIGS. 25A and 25B illustrate the floor panels 126 interconnected at the panel edges 128, where FIG. 25A shows a double spike projection 121 and double spike recession 123 with a center hole 180, and FIG. 25B shows the frictional engagement thereof. In one embodiment, an air conditioning conduit 195 forms at the junction between the double spike projection 121 and the double spike recession 123. Additionally, in FIG. 26A the wall panels 165 are separated, and in FIG. 26B the wall panels 165 are frictionally interconnected.

FIG. 27 is a perspective view of an alternatively shaped shim panel 190 having at least one shim conduit 198. The shim conduit 198 enables passage of wiring 148 and water lines 150. The shim 194 comprises both a shim projection 200 and a shim recession 198. This example can mate with various panels 126, 165, 160 through the utilization projections 122 and recessions 124.

FIG. 28A is a top view of stair panels 127 forming a stair configuration. This is yet another example of the flexible design possibilities offered by the stair panels 127. The numerous positions of the double spike projections 121 and double spike recessions 123 enable the formation of these kinds of designs. Other possible designs formed by the stair panels 127 may include, without limitation, circles, stars, pyramids, ovals, rectangles, and squares. FIG. 28B shows a stair linker 171 with male end 175*a* and a female end 175*b* that links the stair panels 127 in the stair configuration.

FIG. 29 is a perspective close-up view of two curved roof panels 187*a*, 187*b* having a curved male mating surfaces 189*a* and a curved female mating surface 189*b*. The curved configuration of the two curved roof panels 187*a*, 187*b* is designed to channel rain away from an air conditioner conduit 195. FIG. 30 is a perspective close-up view of two curved roof panels 187*a*, 187*b* having curved male mating surfaces 189*a* and a curved female mating surface 189*b* and an air conditioning conduit 195 passing between. FIG. 31 is a perspective close-up view of two curved roof panels 187*a*, 187*b* having holes for receiving fasteners 126, and an air conditioning conduit 195 passing between. The two curved roof panels 187*a*, 187*b* form a flush mating surface 189*a*, 189*b*.

FIGS. 32A, 32B, and 32C show top views of panel edges 141 having a semicircle shaped projections 122 and recessions 124 in a corner panel 202 and a wall panel 165. The semicircle projections 122 and recessions 124 have a greater surface area than the double spike projections 121 and recessions 123, and thus, may be more effective for certain types of structures. Here, FIG. 32A shows two wall panels 165 frictionally interconnected, and FIG. 32B shows a single wall panel 165 with the semicircle shape. FIG. 32C shows a corner panel 202. A semicircle projection 122 frictionally engages an identically shaped semicircle recession 124. A plurality of L-shaped panel conduits 220 can carry wiring and water lines around the bend in the corner panel 202.

FIGS. 33A and 33B are top view of the panel edges 141 having four semicircle shaped projections 122 and four semicircle shaped recessions 124, where FIG. 33A shows two panels 165, 126 frictionally interconnected and FIG. 33B shows a single wall panel 165 with the semicircle shaped projections 122 and recessions 124.

FIG. 34 is a perspective view of an alternatively shaped shim panel 190 having two multi-directional shims 194*a*, 194*b*, a T-projection 230, and a shim conduit 198 that carries wiring 148. The more complex projections and recessions may be effective for creating a tighter frictional interconnection between panels 126, 165. FIG. 35 shows a wall panel 165 and a floor panel 126 frictionally interconnected and having at least one wall conduit 218 for carrying a water line 150. In one embodiment, the water line 150 can include a copper tube that carries a fluid from a source to a tap.

FIGS. 36A, 36B, and 36C illustrate perspective views of various configurations of alternative panels. FIG. 36A shows a flat panel 226, which can be useful as a simple barrier, since the flat panel 226 does not have any projections 122 or recessions 124. The flat panel 226 may also be utilized on the roof region, or as a secondary panel that stacks against the wall panel 165 or the floor panel 126.

FIG. 36B shows a T-panel 228 from a left perspective, and FIG. 36C shows a T-panel 228 from a right perspective. The T-panel 228 utilizes a T-projection 230 and a T-recession 232 that has a substantially T-shaped configuration. The T-shape is an exception to the nonsliding interconnection of the system 100, in that it requires the T-panels 228 to slide against each other, and thus required greater space to assemble. In one possible embodiment, shown in FIGS. 36B and 36C, the T-panel 228 may be defined by an elongated shape, similar to a bar or any such linear support member.

FIGS. 37A, 37B, and 37C are close-up and perspective views of various configurations for a T-panel 228, showing a T-projection 230 in FIG. 37A, and a T-recession 232 in FIG. 37B. Another possible design is illustrated in FIG. 37C, showing exemplary rod 234 joining two T-panels 228. Similarly, FIG. 38 shows a perspective view of the flat panel 226 joining two T-panels 228.

FIG. 39 shows a double-spike wall projection 121 that is adapted to fit into the identical double-spike shape recession 123 of an adjacent wall panel 165. The illustration further shows a cut-out 197 from the wall panel 165, which may be used to incorporate a window or door.

The preceding description of a specific embodiment of the modular system 100 has been directed to modular components as shown in the accompanying drawings. It will be understood that the advantageous frictional engagement between the panel projections 122, 130, 216 and recessions 124, 132, 219 shown incorporated with the wall panel 165, floor panel 126, roof panel 160, stair panel 127, and L-panel 216 may be readily adapted to other modular structures sections such as corner or angle structures and may also be utilized in other than a vertical plane. For example, the panels 165, 126, 160 may be applied in the form of a horizontal ceiling or roof section with the first and second frictional channels 138, 142 and providing adequate structural rigidity to form a self-supporting structures with flexibility.

While the inventor's above description contains many specificities, these should not be construed as limitations on the scope, but rather as an exemplification of several preferred embodiments thereof. Many other variations are possible. For example, the system could be used between a supplier and a wholesale purchaser to incentivize large purchases by providing values through a wholesale networking site. Accordingly, the scope should be determined not by the embodiments illustrated, but by the appended claims and their legal equivalents.

What is claimed is:

1. A modular system for constructing a structure through frictional mating between modular pieces, the system comprises:

a base defined by a pair of channel sides and a pair of tongue sides, each channel side having two base protrusions that extend along the length of the base, wherein a base frictional channel forms between the two base protrusions, the two base protrusions having a plurality of base apertures that form a transverse axis across the two base apertures, each tongue side defined by a tongue that extends along the length of the base;

a wall panel defined by a plurality of wall panel edges arranged to mate with the frictional channel in a frictional snap-lock engagement, at least one of the wall panel edges defined by at least one wall projection that extends laterally, and at least one wall recession that recesses laterally, wherein the at least one wall projection is arranged to mate with the at least one wall recession of an adjacent wall panel in a frictional snap-lock engagement;

a floor panel defined by a plurality of floor panel edges arranged to engage a junction between the tongue and each protrusion, at least one of the floor panel edges defined by at least one floor projection that extends laterally, and at least one floor recession that recesses laterally, wherein the at least one floor projection is arranged to mate with the at least one floor recession of an adjacent floor panel in a frictional snap-lock engagement;

a divider defined by a divider first side having a first frictional channel and a divider second side having a second frictional channel, the divider first side and the divider second side arranged to support the plurality of floor panels, the first frictional channel and the second frictional channel arranged to mate with the plurality of wall panel edges in a frictional snap-lock engagement, wherein the wall panel and the floor panel meet in a substantially perpendicular orientation at the divider;

a roof truss defined by a generally arc shape, the roof truss further defined by a pair of lateral ends, each lateral end having a roof frictional channel, the roof truss further having a plurality of roof apertures extending along the edges of the pair of lateral ends;

a roof panel arranged to mate with the roof frictional channel in a frictional snap-lock engagement; and a roof base defined by a generally rectangular block that provides structural integrity and an adjacent roof base frictional channel that mates with the roof panel in a frictional snap-lock engagement.

2. The system of claim 1, wherein the wall panel provides a substantially vertical structural rigidity for the structure.

3. The system of claim 1, wherein the floor panel provides a substantially horizontal structural rigidity for the structure.

4. The system of claim 1, wherein the at least one wall projection and the at least one wall recession have a double spike shape.

5. The system of claim 1, wherein the at least one floor projection and the at least one floor recession have a double spike shape.

6. The system of claim 1, wherein the wall panel and the floor panel are comprised of multiple panels joined together at a panel seam.

7. The system of claim 6, wherein the panel seam is formed through a frictional snap-lock engagement.

8. The system of claim 1, wherein the wall panel has a wall conduit that carries wiring and a water line through the length of the wall panel.

9. The system of claim 1, wherein the floor panel has a floor conduit that carries wiring and a water line through the length of the floor panel.

10. The system of claim 1, wherein the two protrusions of the base have a plurality of apertures that extend transversely across the length of the base for enabling passage of a fastener.

11. The system of claim 1, wherein the two protrusions and the tongue intersect at a generally perpendicular junction.

12. The system of claim 1, wherein the divider has a divider conduit that carries wiring and a water line through the length of the divider.

13. The system of claim 1, wherein the divider second side has a decorative stepped pattern.

14. The system of claim 1, further including at least one hole that extends vertically to provide plumbing for the system.

15. The system of claim 1, further including a shim panel defined by a shim end having a shim for filling a gap in the frictional channels.

16. The system of claim 1, further including a roof base defined by block and a roof base frictional channel.

17. The system of claim 1, further including a snow roof truss adapted to carry snow from the roof panels.

18. The system of claim 1, further including a channel block defined by a channel block frictional channel.

19. The system of claim 1, further including a flat panel.

20. The system of claim 1, further including a T-panel having a T-projection and a T-recession.

* * * * *